US012006123B2

(12) United States Patent
Bhat et al.

(10) Patent No.: US 12,006,123 B2
(45) Date of Patent: Jun. 11, 2024

(54) BEVERAGE CONTAINER

(71) Applicant: PepsiCo, Inc., Purchase, NY (US)

(72) Inventors: Advait Bhat, White Plains, NY (US); Bruno Telesca, Sandy Hook, CT (US); Marc T. Wiescinski, Downers Grove, IL (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 18/329,936

(22) Filed: Jun. 6, 2023

(65) Prior Publication Data

US 2023/0312214 A1 Oct. 5, 2023

Related U.S. Application Data

(60) Division of application No. 17/374,555, filed on Jul. 13, 2021, now Pat. No. 11,708,206, which is a (Continued)

(51) Int. Cl.
*B65D 79/00* (2006.01)
*B65D 1/02* (2006.01)

(52) U.S. Cl.
CPC ..... *B65D 79/0084* (2020.05); *B65D 1/0223* (2013.01)

(58) Field of Classification Search
CPC ..... A45F 3/20; B65D 1/0223; B65D 23/10; B65D 23/102; B65D 25/104; (Continued)

(56) References Cited

U.S. PATENT DOCUMENTS

D67,464 S 2/1925 Johnson
D96,106 S 2/1935 Fuerst
(Continued)

FOREIGN PATENT DOCUMENTS

CO 7094 8/2012
JP 1021603 7/1998
(Continued)

OTHER PUBLICATIONS

International Search Report and Written Opinion of the International Searching Authority issued in International Application PCT/US2020/018827, dated Jun. 4, 2020 (8 pages).
(Continued)

*Primary Examiner* — Javier A Pagan
(74) *Attorney, Agent, or Firm* — Sterne, Kessler, Goldstein & Fox P.L.L.C.

(57) ABSTRACT

A beverage container includes a base, a sidewall extending from and integrally formed with the base, and an upper region extending from the sidewall and defining an upper opening. The beverage container includes a longitudinal axis extending in a direction from the base to the upper opening. The beverage container further includes a continuous channel formed in and extending continuously around a circumference of the sidewall, wherein the continuous channel includes peaks and troughs connected by diagonal regions. The continuous channel is configured to resist paneling and elongation of the beverage container. The beverage container further includes a central channel formed in and extending continuously around a circumference of the sidewall at a central portion of the sidewall, wherein the central channel is configured to resist paneling of the beverage container.

20 Claims, 14 Drawing Sheets

Related U.S. Application Data continuation-in-part of application No. 16/282,063, filed on Feb. 21, 2019, now Pat. No. 11,447,322.

(58) Field of Classification Search

CPC ..... B65D 79/005; B65D 79/008; B65D 79/0084; B65D 2501/0027; B65D 2501/0036

USPC ..... 215/381, 383

See application file for complete search history.

(56) References Cited

U.S. PATENT DOCUMENTS

| | | | | |
|---|---|---|---|---|
| D104,342 | S | | 5/1937 | Duncan et al. |
| D111,212 | S | | 9/1938 | Meyer |
| D179,173 | S | | 11/1956 | Wilson |
| D188,133 | S | | 6/1960 | Bindman |
| D188,138 | S | | 6/1960 | Bindman |
| D345,693 | S | | 4/1994 | Edstrom |
| 5,704,503 | A | | 1/1998 | Krishnakumar et al. |
| 5,704,504 | A | | 1/1998 | Bueno |
| D393,802 | S | | 4/1998 | Collette et al. |
| D398,855 | S | | 9/1998 | Ito |
| D403,243 | S | | 12/1998 | Takeuchi et al. |
| D404,311 | S | | 1/1999 | Zimmer et al. |
| D412,085 | S | | 7/1999 | Roush et al. |
| D414,112 | S | | 9/1999 | Waggaman et al. |
| D415,413 | S | | 10/1999 | Cummings |
| D417,156 | S | | 11/1999 | Veyssiere |
| 6,036,037 | A | | 3/2000 | Scheffer et al. |
| D423,940 | S | | 5/2000 | Chimetto |
| D424,948 | S | | 5/2000 | Ulmo |
| D430,036 | S | | 8/2000 | Steward et al. |
| D432,018 | S | | 10/2000 | Steward |
| D434,272 | S | | 11/2000 | Johansen et al. |
| D447,061 | S | | 8/2001 | Peck |
| D463,292 | S | | 9/2002 | Del Bianco |
| 6,513,669 | B2 | | 2/2003 | Ozawa et al. |
| 6,581,794 | B2 | | 6/2003 | Boukobza |
| D480,650 | S | | 10/2003 | Moore et al. |
| D491,071 | S | | 6/2004 | Degeyter et al. |
| D493,370 | S | | 7/2004 | Kamineni et al. |
| D494,473 | S | | 8/2004 | Yourist |
| D496,280 | S | | 9/2004 | Mero et al. |
| D503,309 | S | | 3/2005 | Yu |
| D503,341 | S | * | 3/2005 | Delmotte ..... D9/552 |
| D509,436 | S | | 9/2005 | Mero et al. |
| D509,746 | S | | 9/2005 | Mero et al. |
| D510,027 | S | | 9/2005 | Zboch et al. |
| D510,271 | S | | 10/2005 | Mero et al. |
| D515,933 | S | | 2/2006 | Mero et al. |
| D527,267 | S | | 8/2006 | Zboch et al. |
| D527,635 | S | | 9/2006 | Zboch et al. |
| D538,663 | S | | 3/2007 | Kamineni et al. |
| D559,694 | S | | 1/2008 | Le Bras-Brown et al. |
| D570,224 | S | | 1/2008 | Dellevigne |
| D561,597 | S | | 2/2008 | Venkataraman et al. |
| D571,668 | S | | 6/2008 | Dellevigne |
| D596,040 | S | | 7/2009 | Lepoitevin |
| D603,709 | S | | 11/2009 | Lepoitevin |
| D607,747 | S | | 1/2010 | Cella |
| D623,067 | S | | 9/2010 | Lovelace, Jr. et al. |
| D635,461 | S | * | 4/2011 | Inoi ..... D9/557 |
| D644,879 | S | | 9/2011 | Hadley |
| 8,556,098 | B2 | | 10/2013 | Peykoff et al. |
| D757,556 | S | * | 5/2016 | Lesueur ..... D9/555 |
| D763,092 | S | | 8/2016 | Darr |
| D767,993 | S | | 10/2016 | Joshi et al. |
| D803,061 | S | * | 11/2017 | Darr ..... D9/557 |
| D890,611 | S | | 7/2020 | Bhat et al. |
| 11,447,322 | B2 | | 9/2022 | Bhat et al. |
| 2003/0000911 | A1 | | 1/2003 | Kelley et al. |
| 2003/0015491 | A1 | | 1/2003 | Melrose et al. |
| 2008/0093329 | A1 | | 4/2008 | Mooney |
| 2008/0179271 | A1 | | 7/2008 | Bangi |
| 2010/0230378 | A1 | | 9/2010 | Colloud |
| 2011/0127279 | A1 | | 6/2011 | Oshino |
| 2015/0008210 | A1 | * | 1/2015 | Oshino ..... B65D 1/0276 215/373 |
| 2016/0311570 | A1 | | 10/2016 | Didier et al. |
| 2019/0299515 | A1 | * | 10/2019 | Bouffand ..... B65D 1/0284 |
| 2020/0095011 | A1 | | 3/2020 | Klok et al. |
| 2020/0270047 | A1 | | 8/2020 | Bhat et al. |
| 2021/0339934 | A1 | | 11/2021 | Bhat et al. |

FOREIGN PATENT DOCUMENTS

| | | | |
|---|---|---|---|
| JP | 2017/024776 | A | 2/2017 |
| WO | WO 9506593 | A1 | 3/1995 |
| WO | WO DM/047535 | | 3/1999 |
| WO | WO DM/052622 | | 6/2000 |
| WO | WO DM/059103 | | 4/2001 |
| WO | WO DM/062865 | | 1/2003 |
| WO | WO 2013/110631 | A1 | 8/2013 |
| WO | WO 2018/208906 | A1 | 11/2018 |

OTHER PUBLICATIONS

International Search Report and Written Opinion of the International Searching Authority in International Patent Application No. PCT/US2022/036535, dated Oct. 4, 2022 (7 pages).

Extended European Search Report in counterpart European app. no. EP 20759584.4, dated Oct. 28, 2022 (7 pages).

* cited by examiner

BEVERAGE CONTAINER

CROSS-REFERENCE TO RELATED APPLICATIONS

The present application is a divisional of U.S. patent application Ser. No. 17/374,555, filed Jul. 13, 2021, which application is a continuation-in-part of U.S. patent application Ser. No. 16/282,063, filed Feb. 21, 2019, each of which applications are incorporated herein by reference in their entireties.

FIELD

Embodiments described herein generally relate to a beverage container. Specifically, embodiments described herein relate to a beverage container having a sidewall with channels formed in the sidewall that are configured to limit or resist deformation of the beverage container.

BACKGROUND

Beverage containers composed of polyethylene terephthalate and other plastics are used for storing beverages, such as sports drinks, juices, water, and other types of beverages. Forming beverage containers from plastic materials is a cost-effective and convenient alternative to packaging beverages in glass or metal containers due to their light weight, transparency, and ease of production. However, such plastic beverage containers may be susceptible to deformation when exposed to high temperatures or changes in pressure.

BRIEF SUMMARY OF THE INVENTION

Some embodiments are directed to a beverage container that includes a base, a cylindrical sidewall extending from and integrally formed with the base, and an upper region extending from the sidewall and defining an upper opening. The beverage container may include a longitudinal axis extending in a direction from the base to the upper opening. A continuous channel may be formed in and extend around a circumference of the sidewall, and the continuous channel may be sinusoidal such that the continuous channel forms peaks and troughs. A height of the continuous channel as measured in a direction of the longitudinal axis from a peak to a trough may be about 30% to 80% of a height of the sidewall so as to resist elongation of the beverage container in the direction of the longitudinal axis.

Some embodiments are directed to a beverage container that includes a base, a cylindrical sidewall extending from and integrally formed with the base, and an upper region extending from the cylindrical sidewall and defining an upper opening. Diagonal channels may be formed in the sidewall and extend at an oblique angle relative to a plane transverse to a longitudinal axis of the beverage container. The diagonal channels may be spaced along a circumference of the sidewall to resist deformation of the beverage container in a direction of the longitudinal axis of the beverage container and to resist paneling in shape of the sidewall. The beverage container may further include linear channel segments formed in the sidewall and extending along a circumference of the sidewall, wherein the linear channel segments resist paneling of the sidewall when an internal pressure of the beverage container is less than an external pressure.

Some embodiments are directed to a beverage container that includes a cylindrical sidewall and a continuous channel formed in and extending around the sidewall. The continuous channel may have a sinusoidal pattern with three peaks and three troughs such that the continuous channel resists elongation of the beverage container in a direction of a longitudinal axis of the beverage container.

In any of the various embodiments discussed herein, the continuous channel may be configured to resist elongation in a direction of the longitudinal axis when the beverage container is suspended from the upper region and is filled with a beverage having a temperature at or above a glass transition temperature of the beverage container.

In any of the various embodiments discussed herein, the beverage container may include a lower continuous channel and an upper continuous channel that are spaced from one another in a direction of the longitudinal axis of the beverage container. In some embodiments, each of the upper and lower continuous channels may include an upper bound defined as a plane transverse to the longitudinal axis at which the peaks are formed and a lower bound defined as a plane transverse to the longitudinal axis at which the troughs are formed, and the upper bound of the lower continuous channel may be above the lower bound of the upper continuous channel. In some embodiments, the lower continuous channel and the upper continuous channel may have the same dimensions. In some embodiments, the peaks of the lower continuous channel and the upper continuous channel may be aligned in a longitudinal direction of the beverage container.

In any of the various embodiments discussed herein, the continuous channel may include a diagonal region extending between a peak and a trough of the continuous channel that forms an angle with a plane transverse to the longitudinal axis of the beverage container of 40 to 50 degrees. In some embodiments, the angle may be 45 degrees.

In any of the various embodiments discussed herein, the beverage container may further include linear channel segments formed in the sidewall and extending around a portion of the circumference of the sidewall. In some embodiments, the linear channel segments may be arranged in one or more planes transverse to the longitudinal axis of the beverage container. In some embodiments, the linear channel segments may be spaced from the continuous channel. In some embodiments, the continuous channel may include an upper bound that is a plane transverse to the longitudinal axis and at which the peaks are formed, and a lower bound that is a plane transverse to the longitudinal axis and at which the troughs are formed, and wherein the linear channel segments may be positioned between the upper bound and the lower bound.

In any of the various embodiments discussed herein having diagonal channels, the diagonal channels may be arranged at an angle relative to a plane that is transverse to the longitudinal axis of the beverage container that is 40 to 50 degrees. In some embodiments, the diagonal channels may each have the same shape and dimensions. In some embodiments, each of the diagonal channels may have a first end opposite a second end, and a height of each of the diagonal channels measured in a direction of the longitudinal axis from the first end to the second end may be about 30% to 80% of a height of the sidewall of the beverage container. In some embodiments, the diagonal channels may be connected by peaks and troughs so as to form a continuous channel.

Some embodiments are directed to a beverage container that includes a base, a sidewall extending from and integrally formed with the base, an upper region extending from the sidewall and defining an upper opening, wherein the beverage container includes a longitudinal axis extending in a direction from the base to the upper opening. The beverage container includes a first continuous channel formed in and extending continuously around a circumference of the sidewall, wherein the first continuous channel includes peaks and troughs connected by diagonal regions, and wherein the first continuous channel is configured to resist paneling and elongation of the beverage container. The beverage container further includes a second continuous channel formed in and extending continuously around a circumference of the sidewall, wherein the second continuous channel includes peaks and troughs connected by diagonal regions, and wherein the second continuous channel is configured to resist paneling and elongation of the beverage container. The beverage container further includes a central channel formed in and extending continuously around a circumference of the sidewall at a central portion of the sidewall between the first and second continuous channels, wherein the central channel is configured to resist paneling of the beverage container.

Some embodiments are directed to a beverage container that includes a base, a sidewall extending from and integrally formed with the base, and an upper region extending from the sidewall and defining an upper opening, wherein the beverage container includes a longitudinal axis extending in a direction from the base to the upper opening. The beverage container further includes a first continuous channel formed in and extending around a circumference of the sidewall, wherein the continuous channel includes peaks and troughs connected by diagonal regions, and wherein the continuous channel is configured to resist paneling and elongation of the beverage container. The beverage container further includes a second continuous channel formed in and extending around a circumference of the sidewall, wherein the second continuous channel includes peaks and troughs connected by diagonal regions, and the second continuous channel is configured to resist paneling and elongation of the beverage container. The beverage container further includes one or more vacuum panels formed in the sidewall of the beverage container and arranged between the first and second continuous channels.

Some embodiments are directed to a beverage container that includes a base, a sidewall extending from and integrally formed with the base, and an upper region extending from the sidewall and defining an upper opening, wherein the beverage container includes a longitudinal axis extending in a direction from the base to the upper opening. The beverage container further includes a continuous channel formed in and extending around a circumference of the sidewall, wherein the continuous channel includes peaks and troughs connected by diagonal regions, and the continuous channel is configured to resist paneling and elongation of the beverage container. The beverage container further includes one or more vacuum panels formed in the sidewall of the beverage container. In any of the various embodiments discussed herein having vacuum panels, a vacuum panel of the one or more vacuum panels may have a perimeter, an inner wall that slopes from the perimeter to a bottom of the vacuum panel, and one or more projections extending from the bottom of the vacuum panel.

In any of the various embodiments discussed herein, the central channel may be arranged in a plane transverse to the longitudinal axis of the beverage container.

In any of the various embodiments discussed herein, the central channel may be arranged at a midpoint of the sidewall in the direction of the longitudinal axis.

In any of the various embodiments discussed herein, the diagonal regions of the first continuous channel may form an angle of 40 to 50 degrees relative to a plane transverse to the longitudinal axis of the beverage container.

In any of the various embodiments discussed herein, the beverage container may further include linear channel segments formed in the sidewall and extending along a circumference of the sidewall, wherein the linear channel segments may be configured to resist paneling of the sidewall when an internal pressure of the beverage container is less than an external pressure. In some embodiments, one or more of the linear channel segments may be arranged on the sidewall between the first continuous channel and the central channel. In some embodiments, one or more of the linear channel segments may be arranged on the sidewall above the first continuous channel.

In any of the various embodiments discussed herein, the peaks of the first continuous channel and the peaks of the second continuous channel may be aligned in the direction of the longitudinal axis of the beverage container.

In any of the various embodiments discussed herein having vacuum panels, the one or more vacuum panels may include seven to ten vacuum panels.

In any of the various embodiments discussed herein having vacuum panels, the peaks of the first continuous channel may be aligned with troughs of the second continuous channel in a direction of the longitudinal axis.

In any of the various embodiments discussed herein having vacuum panels, each vacuum panel of the one or more vacuum panels may be arranged between a peak of the first continuous channel and a trough of the second continuous channel.

In any of the various embodiments discussed herein having vacuum panels, each of the one or more vacuum panels may include a width in a circumferential direction that is less than a circumferential distance measured from a first peak of the first continuous channel to a second peak of the first continuous channel.

In any of the various embodiments described herein having vacuum panels, the one or more vacuum panels may include a number of vacuum panels that is the same as a number of peaks of the first continuous channel.

In any of the various embodiments described herein having vacuum panels, the perimeter may include an oval shape.

In any of the various embodiments described herein having vacuum panels, the inner wall may be arranged at an angle relative to a longitudinal axis of the vacuum panel in a range of 1 degree to 50 degrees.

In any of the various embodiments described herein having vacuum panels, the inner wall may further include a step.

In any of the various embodiments described herein having vacuum panels, the vacuum panel of the one or more vacuum panels may further include a trench formed in the bottom of the vacuum panel, wherein the trench is configured to allow the bottom to flex in multiple directions.

In any of the various embodiments described herein having vacuum panels, the vacuum panel of the one or more vacuum panels may further include one or more recesses formed in the bottom of the vacuum panel.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
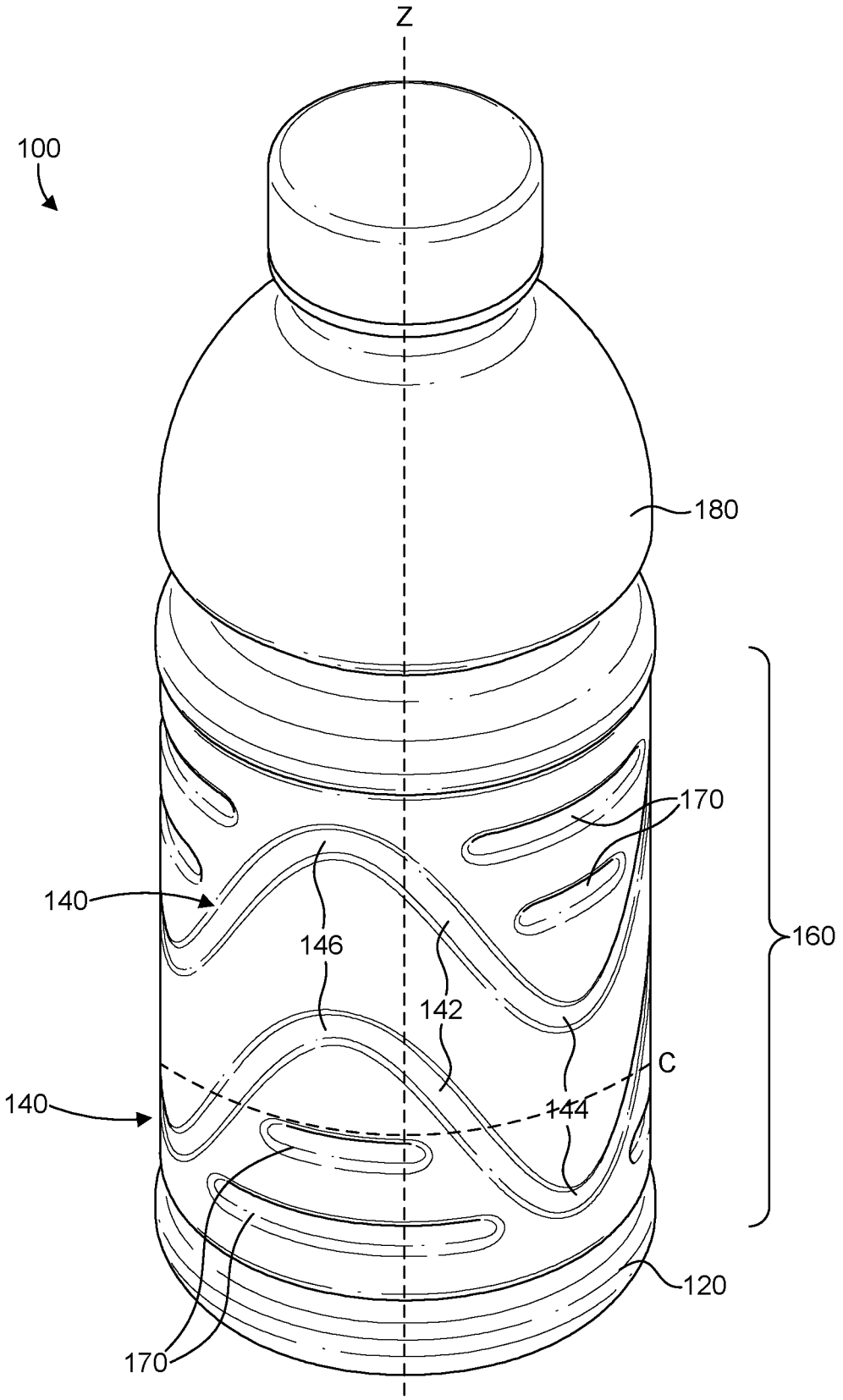
FIG. 1 shows a perspective view of a beverage container according to an embodiment.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Beverage containers for storing various types of beverages may be composed of a plastic material, such as polyethylene terephthalate (PET), among others. Such plastic beverage containers often have a generally cylindrical construction. Plastic beverage containers may be filled with a beverage via a hot-filling operation. In a hot-filling operation, a beverage to be stored in the beverage container is heated to an elevated temperature, such as a temperature of about 170° F. or more, and deposited in the beverage container. The beverage container may be supported on a support surface during filling, or the beverage container may be suspended by an upper end, or neck, of the beverage container during filling. Once filled and capped, the beverage container and beverage therein are rapidly cooled. This cooling of the beverage may result in thermal contraction, which reduces the internal volume of the beverage container. To accommodate the resulting pressure differential, side walls of the beverage container may be pulled inward. Depending on the structure of the beverage container, including its sidewall, this can result in undesirable deformation, or "paneling" of the side wall, where a once-cylindrical sidewall takes on flattened or otherwise deformed shapes in order to accommodate the internal vacuum created by the reduction in volume of the beverage due to thermal contraction during cooling.

To help the beverage container to maintain its cylindrical shape throughout the process of filling the beverage container with a liquid and subsequently during storage and transportation of the beverage container, one or more ribs may be formed in the beverage container. The ribs may be formed on the beverage container as recessed (indented) channels that extend toward an interior volume of the beverage container and extend completely around the circumference of the beverage container in a plane transverse to a longitudinal axis of the beverage container. The ribs help to prevent the beverage container from paneling or otherwise deforming when an internal pressure of the beverage container is less than an external pressure. Such paneling may reduce the structural stability of the beverage container. Also, beverage containers that experience deformation may be unappealing to consumers, which may negatively impact sales of the beverage containers. While the ribs extending around a circumference of the beverage container may help to avoid paneling, the ribs may make the beverage container more susceptible to elongation in a longitudinal direction during certain types of filling operations.

As the beverage container is composed of plastic, the plastic may begin to deform if heated to a sufficiently high temperature, such as a temperature at or above the glass transition temperature of the beverage container. As a result, when the beverage container is suspended from its upper end or neck and is filled with a high temperature beverage, the weight of the beverage within the container and the heat may cause the beverage container to elongate in a longitudinal direction. Specifically, elongation may be most significant at the ribs of the beverage container, as the ribs may stretch or flatten, resulting in elongation of the beverage container.

Elongation of the beverage container may be undesirable because the elongation may result in beverage containers having different heights. Beverage containers having various heights may make it difficult to stack and store the beverage containers. For example, a case of beverage containers having varying heights may not evenly carry the load of another case of beverage containers stacked atop the first.

The taller beverage containers may carry more of the load than the shorter ones, and may apply uneven pressure to the second case. This may make the second case sit unevenly on the first, making stacking and storage more difficult. This problem may compound as additional cases of beverage containers are stacked on top of one another.

In some embodiments described herein, a beverage container includes a sidewall with a channel formed in the sidewall having a sinusoidal shape that extends around a circumference of the beverage container. The channel helps to resist elongation of the beverage container, such as during hot-filling operations, while also providing resistance to paneling. The sidewall of the beverage container may further include linear channel segments that extend along a portion of a circumference of the sidewall. The linear channel segments may provide further resistance to paneling.

In some embodiments, as shown, for example, in FIG. 1, a beverage container 100 includes a base 120, a sidewall 160 extending from and integrally formed with base 120, and an upper region 180 extending from and integrally formed with sidewall 160 and defining an upper opening. Beverage container 100 may include a recessed region 190 where sidewall 160 transitions to upper region 180. Beverage container 100 includes a longitudinal axis Z extending centrally in a direction from base 120 to upper region 180. Sidewall 160 is generally cylindrical such that beverage container 100 has a generally circular transverse cross section (not accounting for channels formed in sidewall 160).

Figure 2:
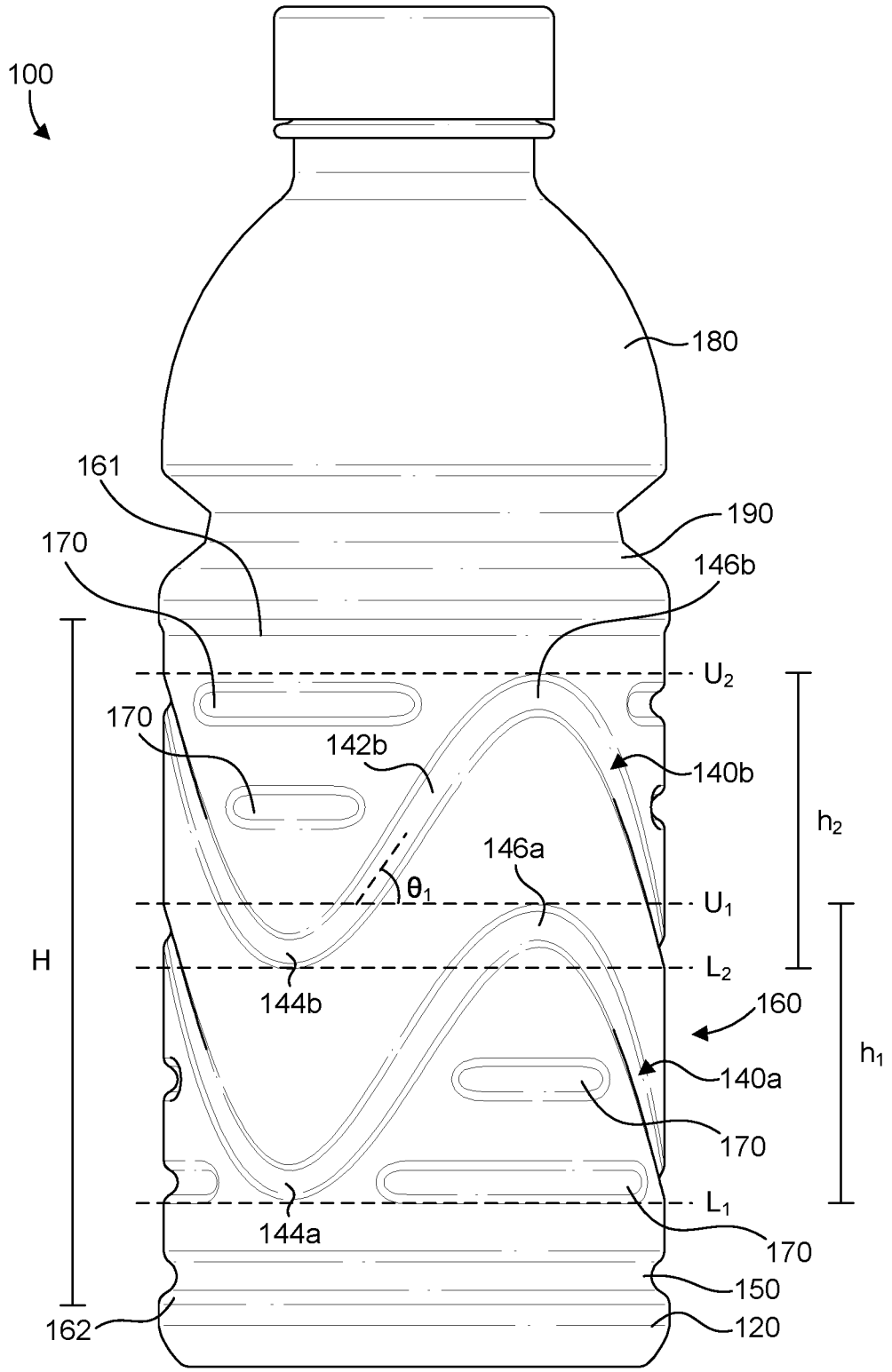
FIG. 2 shows a side view of a portion of a sidewall of the beverage container of FIG. 1.

In some embodiments, sidewall 160 of beverage container 100 may include one or more circumferential channels 150 extending continuously around a circumference of sidewall 160. In FIG. 2, one circumferential channel 150 is arranged at lower end 162 of sidewall 160 adjacent base 120. As discussed above, circumferential channel 150 may help to provide sidewall 160 with hoop strength and resistance to paneling but may be susceptible to elongation.

As shown in FIG. 1, one or more channels 140 are formed in sidewall 160 that serve to prevent or limit elongation of beverage container 100 in a direction of the longitudinal axis Z. Channels 140 are formed as recessed areas in sidewall 160 that extend toward an interior volume of beverage container 100. Channels 140 also serve to resist paneling of sidewall 160 (e.g., when an internal pressure of beverage container 100 is less than an external pressure) by contributing hoop strength to beverage container 100. Specifically, beverage container 100 is configured to resist elongation in a direction of longitudinal axis Z when beverage container 100 is suspended from upper region 180 and is filled with a beverage having a temperature at or above a glass transition temperature of the material forming beverage container 100 (e.g., PET).

In some embodiments, a continuous channel 140 is formed in sidewall 160 and extends around a circumference C of sidewall 160. In some embodiments, continuous channel 140 has a sinusoidal shape such that continuous channel 140 includes a series of alternating peaks 146 and troughs 144 separated by diagonal regions 142. Diagonal regions 142 may be generally linear or may have a slight curvature so as to be curvilinear. It is understood that diagonal regions 142 may necessarily have a slight curvature as diagonal regions 142 extend around a portion of cylindrical sidewall 160. Further, in some embodiments, diagonal region 142 may have a slight curvature as a diagonal region 142 approaches a peak 146 or a trough 144. In some embodiments, continuous channel 140 may form three peaks 146 (and thus three troughs 144). Some embodiments may include additional or fewer peaks 146, however, due to approach and passage through a transverse plane relative to longitudinal axis Z, peaks 146 and troughs 144 may be more susceptible to elongation than diagonal regions 142 of continuous channel 140. As a result, the susceptibility of beverage container 100 to elongation decreases as the number of peaks 146 (and troughs 144) is reduced.

Continuous channels 140 serve a dual purpose: to resist or prevent elongation of beverage container 100 in a direction of longitudinal axis Z during hot-filling operations, and to resist or prevent paneling of beverage container 100 when an internal pressure of beverage container 100 is less than an external pressure. As discussed, ribs (or channels) that extend circumferentially around the beverage container and that are oriented in or near a plane transverse to a longitudinal axis Z may be susceptible to elongation in the direction of longitudinal axis Z, because, for example, the weight of a high-temperature beverage will be directed in the direction of longitudinal axis Z, nearly perpendicularly to the ribs. However, diagonal regions 142 of continuous channel 140 are less susceptible to elongation because diagonal regions 142 are oriented at an angle relative to a transverse plane. As a result, when beverage container 100 is filled with a high-temperature beverage, beverage container 100 is less able to stretch longitudinally in diagonal region 142 of continuous channel 140. The weight of the high-temperature beverage (in the direction of longitudinal axis Z) will not be perpendicular to the direction of diagonal region 142 and will instead be at an angle thereto.

Further, as continuous channels 140 extend around a circumference C of sidewall 160, continuous channels 140 inhibit sidewall 160 from deforming, such as collapsing toward an interior of beverage container 100 when an internal pressure of beverage container 100 is greater than an external pressure. Thus, continuous channels 140 also help sidewall 160 to maintain a cylindrical configuration.

As shown in FIG. 2, diagonal regions 142 of continuous channel 140 are formed at an angle $\theta_1$, relative to a plane that is transverse to longitudinal axis Z of beverage container 100. In some embodiments, angle $\theta_1$, may be, for example, 40 to 50 degrees. In some embodiments, the angle may be 45 degrees so as to balance resistance to paneling when beverage container 100 is subjected to a pressure differential and resistance to elongation during hot-filling operations. As angle $\theta_1$ decreases, such that continuous channel 140 is flattened and the sinusoidal pattern has a lower amplitude, the resistance to elongation provided by continuous channel 140 decreases while resistance to paneling increases.

Figure 3:
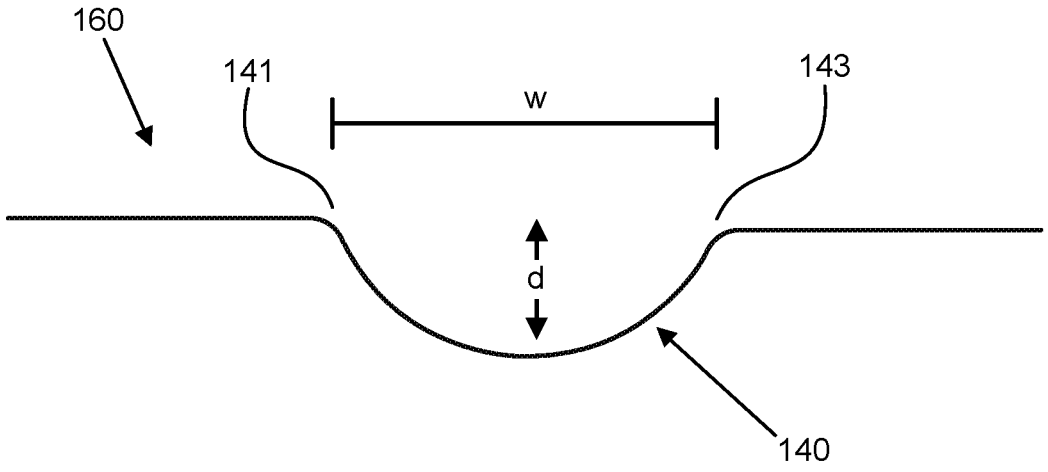
FIG. 3 shows a close-up cross sectional view of a channel of the sidewall of the beverage container of FIG. 1.

In some embodiments, channels 140 have a rounded indented surface, as shown for example at FIG. 3. Continuous channels 140 may take the form of a circular arc (e.g., a semi-circle) in cross section. However, channels 140 may have other cross-sectional shapes, for example a U-shape or parabolic cross-sectional shape, among others. In some embodiments, continuous channels 140 may have a width w as measured in a transverse direction of a channel 140 from a first side 141 to an opposing second side 143 of channel 140. Width w may be, for example, 4 mm to 8 mm. In some embodiments, continuous channels 140 may have a depth d as measured from a plane of sidewall 160 to a deepest portion of channel 140. Depth d may be, for example, 0.5 mm to 4 mm (e.g., 0.8 mm).

In some embodiments, continuous channels 140 have a circular-arc cross section based on a circle of 4 mm to 8 mm (e.g., 6 mm) diameter, with a depth d of 0.5 mm to 4 mm (e.g., 0.8 mm). As depth d of continuous channel 140 increases, the resistance of beverage container 100 to paneling increases. However, increasing depth d of channel 140 may make beverage container 100 more susceptible to elongation in a longitudinal direction. In some embodiments, all continuous channels 140 have the same cross-sectional size and shape.

In some embodiments, sidewall 160 is formed with two or more continuous channels 140*a*, 140*b*, such as a lower continuous channel 140*a* and an upper continuous channel 140*b*, as shown in FIG. 2. Lower continuous channel 140*a* and upper continuous channel 140*b* are spaced from one another in a longitudinal direction. In some embodiments, sidewall 160 may include three or more continuous channels 140. However, as the number of continuous channels 140 increases, the ability of beverage container 100 to resist elongation may decrease because peaks 146 and troughs 144 are more susceptible to elongation than diagonal regions 142 as discussed above, and thus additional peaks 146 and troughs 144 formed in additional continuous channels 140 may make beverage container 100 more susceptible to elongation.

In some embodiments, lower and upper continuous channels 140*a*, 140*b* may be formed with the same shape and dimensions. Thus, each channel 140*a*, 140*b* may be sinusoidal. Each channel 140*a*, 140*b* may have the same height as measured in a longitudinal direction from a trough 144 to a peak 146 of a continuous channel 140, and each channel 140*a*, 140*b* may have the same number of peaks 146 and troughs 144. The lower and upper continuous channels 140*a*, 140*b* may be in-phase with one another, such that peaks 146*a*, 146*b* of the lower and upper continuous channels 140*a*, 140*b* are aligned in the longitudinal direction of beverage container 100.

In some embodiments, each continuous channel 140 includes a lower bound L and an upper bound U, as best shown in FIG. 2. Lower bound L is a plane transverse to longitudinal axis Z of beverage container 100, and similarly upper bound U is a plane that is parallel to lower bound L and transverse to longitudinal axis Z. Each continuous channel 140 oscillates between its lower bound L and upper bound U. In some embodiments, each peak 146 of a continuous channel 140 is formed at upper bound U and each trough 144 is formed at lower bound L.

Each continuous channel 140 has a height measured in a direction of longitudinal axis Z from trough 144 to peak 146 (or lower bound L to upper bound U). Lower continuous channel 140 has a height $h_1$, and upper continuous channel 140*b* has a height $h_2$ that may be the same as $h_1$. In some embodiments, a height, $h_1$ or $h_2$, of each continuous channel 140 may be about 30% to about 80% of a height of sidewall 160. In some embodiments, each continuous channel 140 may be about 40% to about 70% of the height of sidewall 160. The height, H, of sidewall 160 is measured from a lower end 162 of sidewall 160 adjacent base 120 in a direction of longitudinal axis Z to an upper end 161 of sidewall 160 adjacent upper region 180.

In some embodiments, upper bound $U_1$ of a lower continuous channel 140*a* may be above lower bound $L_2$ of an upper continuous channel 140*b*. In this way, continuous channels 140*a*, 140*b* are spaced closely together such that a plane transverse to longitudinal axis Z intersects at least a portion of a continuous channel 140. In some embodiments, upper bound $U_1$ of lower continuous channel 140*a* may be at or below lower bound $L_2$ of upper continuous channel 140*b*.

Figure 4:
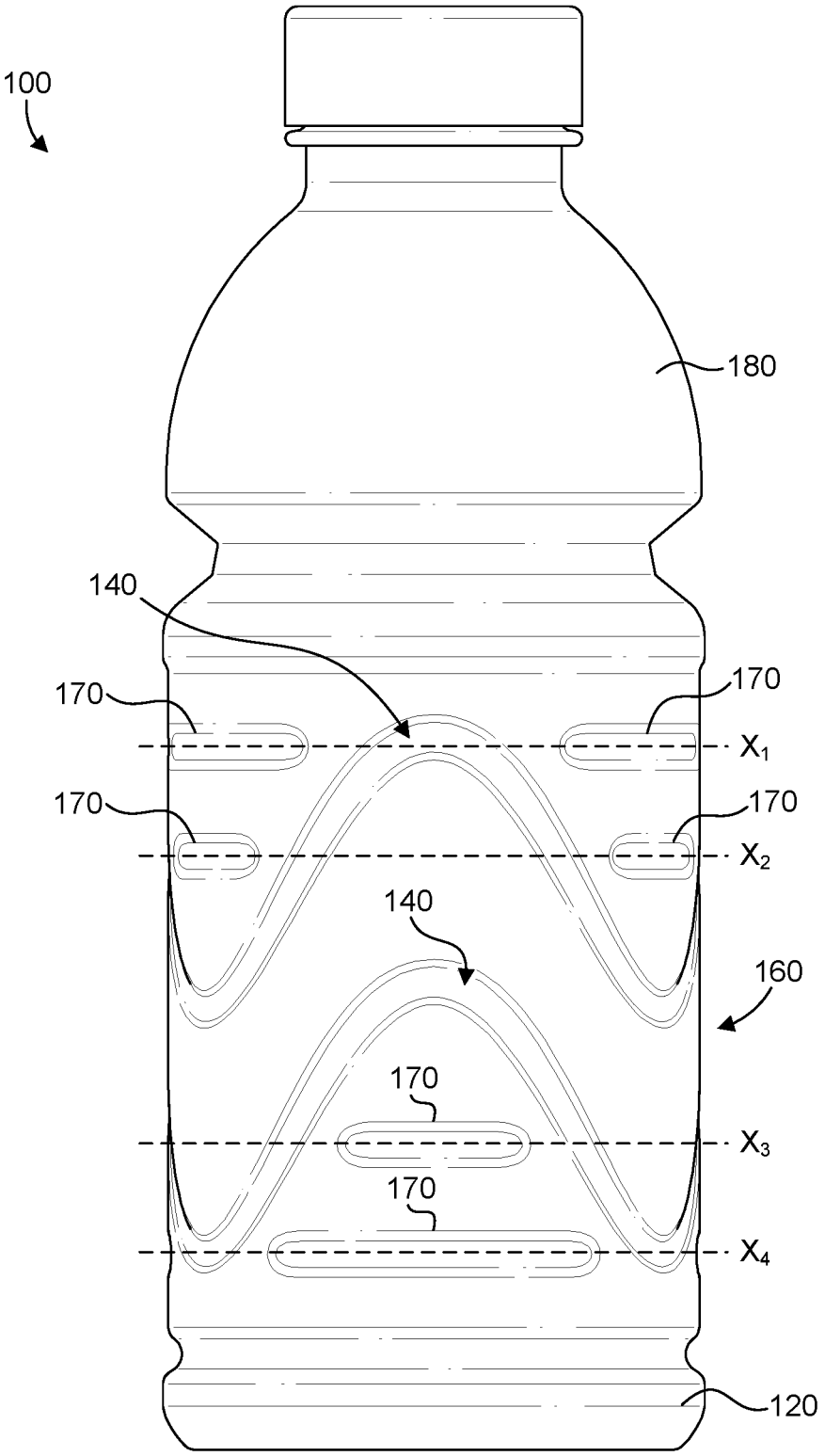
FIG. 4 shows a side view of a portion of a sidewall of the beverage container of FIG. 1.

In some embodiments, sidewall 160 of beverage container 100 further includes linear channel segments 170, as shown in FIG. 4. Linear channel segments 170 provide additional resistance to paneling of sidewall 160 of beverage container 100 when an internal pressure of beverage container 100 is less than an external pressure by contributing hoop strength to beverage container 100. Thus, linear channel segments 170 help sidewall 160 of beverage container 100 to retain its cylindrical shape throughout filling, transportation, and storage of beverage container 100.

Linear channel segments 170 extend around a portion of a circumference of sidewall 160. Similarly to continuous channels 140, linear channel segments 170 may be formed in sidewall 160 as recessed areas that extend towards an interior volume of beverage container 100. Linear channel segments 170 may be positioned in one or more planes, e.g., $X_1$, $X_2$, $X_3$ and $X_4$, that are transverse to longitudinal axis Z of beverage container 100. Each transverse plane may have multiple linear channel segments 170 that are spaced from one another around the circumference of sidewall 160. In some embodiments, a plane extending transversely to longitudinal axis Z may include four linear channel segments 170 spaced around the circumference of sidewall 160. Linear channel segments 170 in a particular plane may each be the same shape and dimensions. In some embodiments, linear channel segments 170 in a first plane $X_1$ may extend around a circumference to a greater extent than linear channel segments 170 arranged in a second plane $X_2$, such that the linear channel segments 170 in each plane differ in length. In some embodiments, linear segments 170 in different planes, e.g., plane $X_1$ and $X_2$, may be aligned on sidewall 160 along longitudinal axis Z.

Linear channel segments 170 may be formed in sidewall 160 in an area between a lower bound L and an upper bound U of a continuous channel 140, as shown in FIG. 2. Linear channel segments 170 are spaced from continuous channel 140 such that linear channel segments 170 do not intersect or overlap with continuous channel 140. Thus, linear channel segments 170 provide additional resistance to paneling in areas of sidewall 160 not occupied by continuous channels 140. As linear channel segments 170 do not extend continuously around circumference C of beverage container 100, linear channel segments 170 do not have a significant tendency to deform in the direction of longitudinal axis Z. The sidewall material that interrupts them constrains such deformation.

Linear channel segments 170 may have a rounded indented surface. Similar to continuous channels 140, linear channel segments 170 may take the form of a circular arc (e.g., a semi-circle) in cross-section. However, linear channel segments 170 may have other cross-sectional shapes, for example, a U-shape or parabolic cross-sectional shape, among others. Similar to the representation of continuous channel 140 shown in FIG. 3, in some embodiments, linear channel segments 170 have a width as measured in a transverse direction of a channel segment 170 from a first side to an opposing second side of channel segment 170. The width may be, for example, 4 mm to 8 mm (e.g., 5 mm to 7 mm). In some embodiments, linear channel segments 170 may have a depth as measured from a plane of sidewall 160 to a deepest portion of channel segment 140. The depth may be, for example, 2 mm to 4 mm (e.g., 3 mm).

In some embodiments, linear channel segments 170 have a semi-circular cross section with a diameter of 4 mm. In some embodiments, all linear channel segments 170 have the same cross-sectional size and shape. In some embodiments, each linear channel segment 170 may be formed with a deeper depth than depth d of continuous channel 140. In some embodiments, at least some linear channel segments 170 may have the same cross-sectional size and shape as at least some continuous channels 140.

Figure 5:
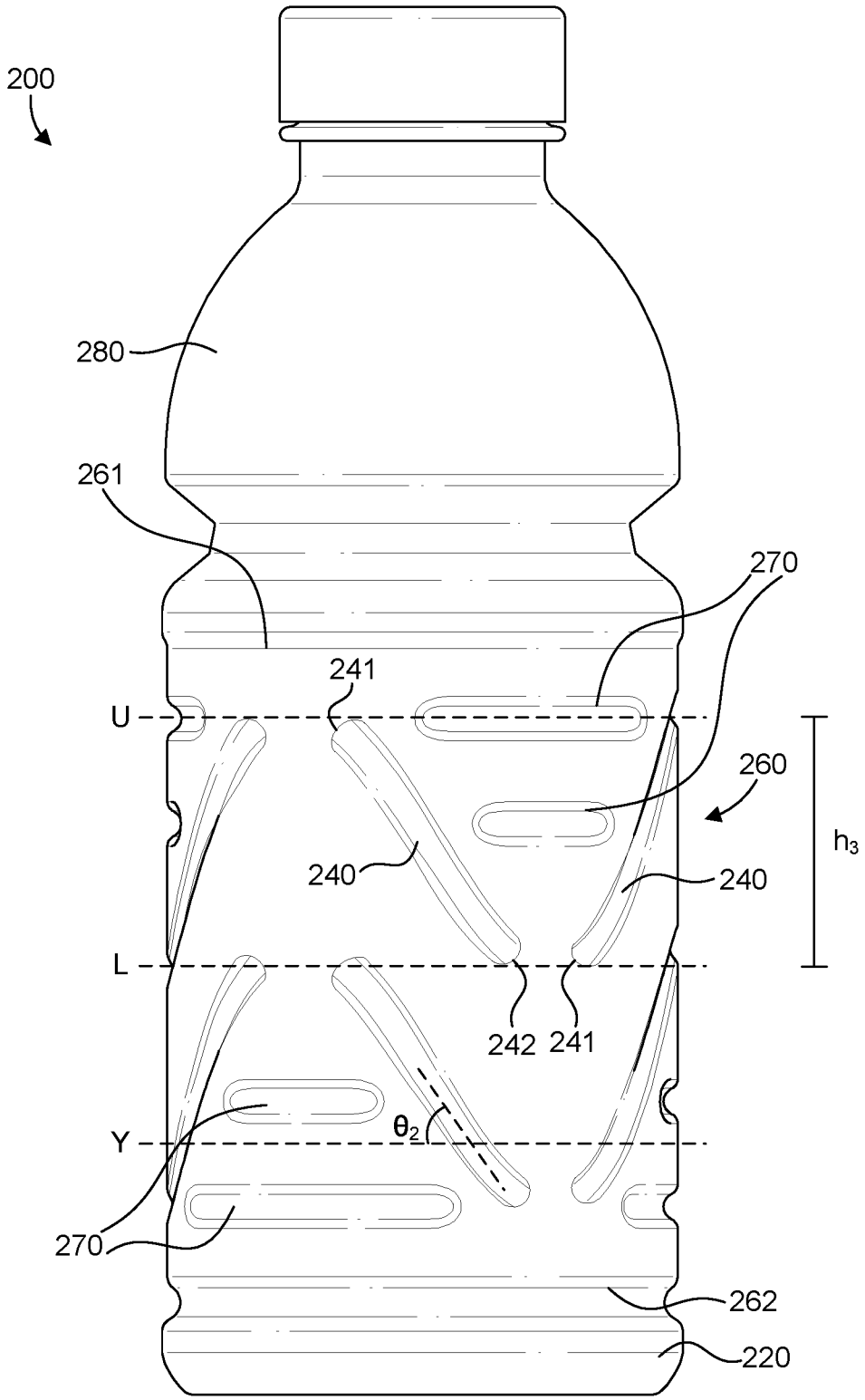
FIG. 5 shows a side view of a beverage container according to an embodiment.

In some embodiments, as shown in FIG. 5, a beverage container 200 includes a base 220, a sidewall 260 extending from and integrally formed with base 220, and an upper region 280 extending from and integrally formed with sidewall 260 and defining an upper opening. Beverage container 200 includes a longitudinal axis extending in a direction from base 220 to upper region 280. Sidewall 260 is generally cylindrical such that beverage container 200 has a generally circular transverse cross section. Thus, beverage container 200 is formed in the same manner as beverage container 100 and differs in that beverage container 200 includes a plurality of diagonal channels 240 formed in sidewall 260 and that are spaced around a circumference of sidewall 260. Each diagonal channel 240 may have the same shape and dimensions. In some embodiments, six diagonal channels 240 extend around a circumference of sidewall 260. In other embodiments, fewer or additional diagonal channels 240 may be formed in sidewall 260.

Similar to diagonal regions 142 of continuous channels 140 of beverage container 100 as shown in FIGS. 1, 2 and 4, diagonal channels 240 of beverage container 200 serve to resist or limit elongation of beverage container 200 in a longitudinal direction, such as during hot-filling operations. As discussed with respect to continuous channels 140 of beverage container 100, diagonal channels 240 also help to prevent paneling of sidewall 260 when an internal pressure of beverage container 200 is less than an external pressure, as diagonal channels 240 extend around the circumference of sidewall 260.

Diagonal channels 240 are oriented at an angle $\theta_2$ relative to a plane Y that is transverse to longitudinal axis Z. The angle may be, for example, 40 to 50 degrees. In some embodiments, the angle is 45 degrees. Further, each diagonal channel 240 may extend between a lower bound L defined as a plane transverse to a longitudinal axis of beverage container 200 and an upper bound U defined as a plane transverse to longitudinal axis that is parallel to lower bound L. A first diagonal channel 240 may have a first end 241 at an upper bound U and extends along sidewall 260 in a counter-clockwise direction to a second end 242 at a lower bound L, and an adjacent diagonal channel 240 may have a first end 241 at lower bound L and extends along sidewall 260 in a counter-clockwise direction to a second end 242 at upper bound U. In this way, diagonal channels 240 may form a discontinuous, wave-like pattern. In some embodiments, however, diagonal channels 240 may be connected, e.g., by connecting a second end 242 of a first diagonal channel 240 to a first end 241 of a second diagonal channel 240 so as to form peaks and troughs, and forming a continuous channel comprising diagonal channels 240 that extends around a circumference of sidewall 260.

Each diagonal channel 240 has a height $h_3$, measured in a direction of longitudinal axis Z from first end 241 to second end 242 (or from lower bound L to upper bound U). In some embodiments height $h_3$ of each diagonal channel 240 may be about 30% to about 80% of a height of sidewall 260. In some embodiments, each diagonal channel 240 may be about 40% to about 70% of the height of sidewall 260. The height of sidewall 260 is measured from a lower end 262 of sidewall 260 adjacent base 220 in a direction of the longitudinal axis to an upper end 261 of sidewall 260 adjacent upper region 280.

In some embodiments, diagonal channels 240 may have a cross sectional shape, width and depth as discussed above with respect to continuous channels 140. Thus, diagonal channels 240 may be radiused so as to have a rounded surface. Diagonal channels 240 may be generally semi-circular in cross section. However, diagonal channels 240 may have alternate cross-sectional shapes and may have a U-shape or parabolic cross-sectional shape, among others. In some embodiments, diagonal channels 240 may have a diameter or width of 4 mm to 8 mm. In some embodiments, diagonal channels 240 may have a depth of 0.5 mm to 4 mm, and in an embodiment the depth may be 0.8 mm. As the depth of diagonal channels 240 increases, the resistance of beverage container 200 to paneling increases. However, increasing depth of diagonal channel 240 makes beverage container 200 more susceptible to elongation in a longitudinal direction.

In some embodiments, sidewall 260 may include diagonal channels 240 extending around a circumference of sidewall 260 that are centered along two or more planes that are transverse to a longitudinal axis of beverage container 200. Thus, diagonals channels 240 may be arranged on sidewall 260 in two or more rows. Diagonal channels 240 in each row may be aligned in a longitudinal direction of beverage container 200.

In some embodiments, beverage container 200 may further include a plurality of linear channel segments 270 formed in sidewall 260 of beverage container 200. Linear channel segments 270 may have the same shape, arrangement, and function as described above with respect to linear channel segments 170 of beverage container 100.

Figure 6:
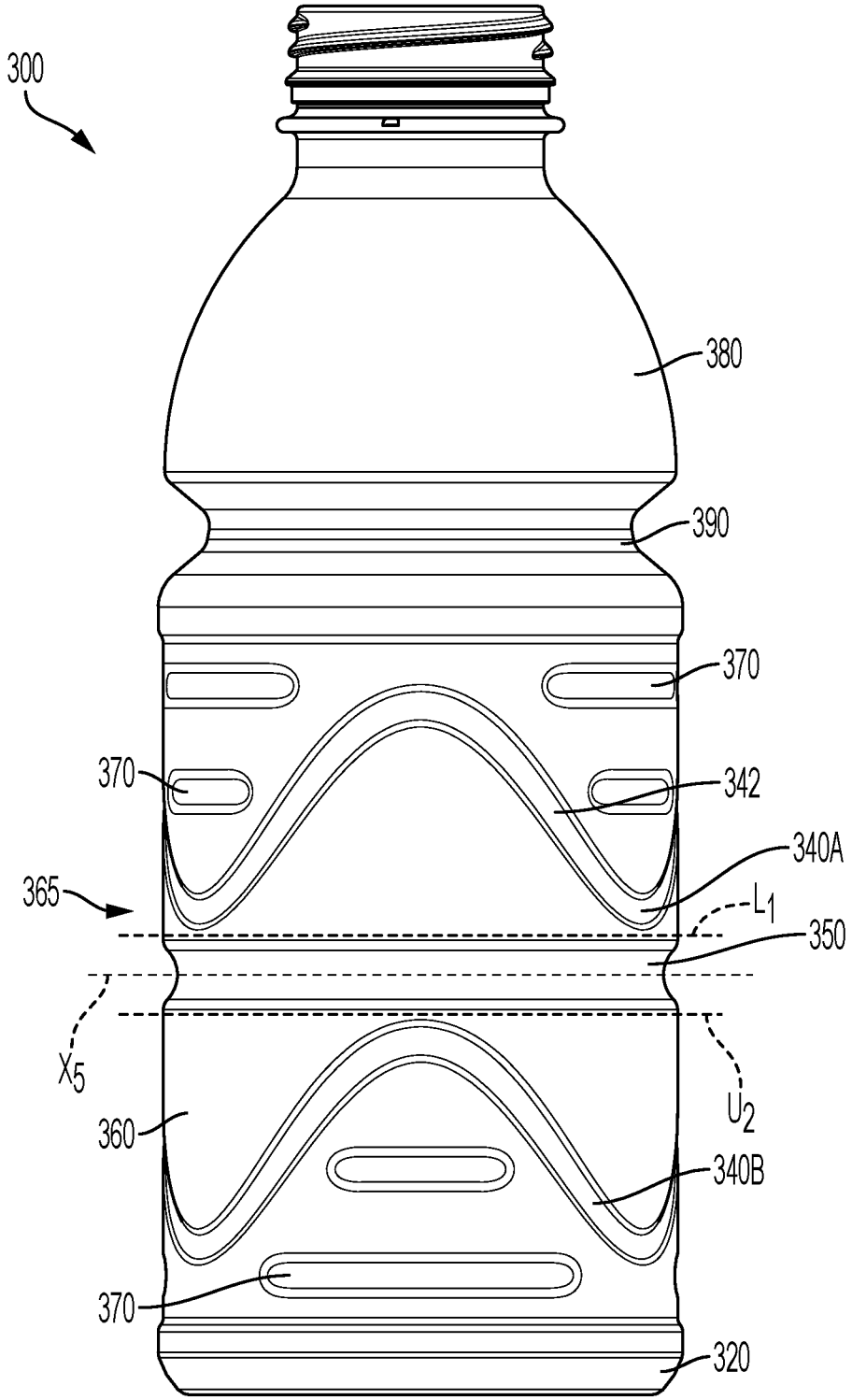
FIG. 6 shows a side view of a beverage container according to an embodiment.

In some embodiments, a beverage container 300 may include a sidewall 360 having a one or more central channels 350, as shown in FIG. 6. Beverage container 300 may be formed as discussed above with respect to beverage containers 100, 200, and thus may have a base 320, a sidewall 360 extending from an integrally formed with base 320, and an upper region 380 extending from and integrally formed with sidewall 360 and defining an upper opening. Further, beverage container 300 may include a recessed region 390 where sidewall 360 transitions to upper region 380, and sidewall 360 may be cylindrical such that beverage container 300 has a generally circular transverse cross section.

Beverage container 300 differs from beverage container 100 primarily in having one or more central channels 350 arranged at a central portion 365 of sidewall 360 rather than having a circumferential channel 150 at lower end 162 of sidewall 160 as in beverage container 100 shown for example in FIG. 2. Beverage container 300 may include one or more continuous channels 340 having the shape, arrangement, and functions as described above with respect to continuous channels 140 unless specifically noted otherwise. Further, beverage container 300 may include linear channel segments 370 having the same shape, arrangement, and functions as described above with respect to linear channel segments 170 unless specifically noted otherwise.

A central portion of a sidewall of a beverage container may be more prone to paneling than portions of the sidewall that are closer to the upper region or the base of the beverage container, which have relatively high hoop strength. Arranging one or more central channels 350 at a central portion 365 of sidewall 360 was found to reinforce central portion 365 of sidewall 360 and provide additional hoop strength, i.e., greater resistance to paneling, and arranging one or more continuous channels 340 above, below, or above and below central channel(s) 350 provides sidewall 360 with resistance to elongation. Thus, central channel(s) 350 can be positioned at a location on container 300 of relatively higher susceptibility to paneling, while channels 340 above and below central channel(s) 350 can still provide resistance to elongation in the manner discussed above.

In some embodiments, a central channel 350 is arranged on a central portion 365 of sidewall 360 of beverage container 300 in a longitudinal direction between base 320 and upper region 380. In some embodiments, a single central channel 350 may be arranged at a midpoint of sidewall 360. Central channels 350 may be formed in and may extend continuously around a circumference of sidewall 360 of beverage container 300. Central channel 350 may be arranged in a plane $X_5$ transverse to a longitudinal axis of beverage container 300.

Central channel 350 may have a width in a range of about 3 mm to about 12 mm in a transverse direction across channel 350 (i.e., in a vertical direction as shown in FIG. 6) from a first side to an opposing second side of channel 350. Central channel 350 may have a depth of about 0.5 mm to about 8 mm as measured from a plane of sidewall 360 to a deepest portion of central channel 350. Central channel 350 may be wider than it is deep. By forming a wide and shallow central channel 350, the susceptibility of central channel 350 to elongation is minimized. Generally, the greater the depth of a continuous circumferential channel, the greater the susceptibility of the channel to elongation.

In some embodiments, sidewall 360 of beverage container 300 may include two continuous channels 340 (340A and 340B), as shown for example in FIG. 6. Central channel 350 may be arranged between the two continuous channels 340, such that an upper continuous channel 340A is arranged above central channel 350 (i.e., closer to upper region 380) and a lower continuous channel 340B is arranged below central channel 350 (i.e., closer to base 320). Upper and lower continuous channels 340A, 340B may be spaced from one another in the direction of the longitudinal axis of the beverage container 300.

Upper and lower continuous channels 340A, 340B may be formed as discussed above with respect to continuous channels 140. However, as sidewall 360 of beverage container 300 includes a central channel 350 that occupies a portion of sidewall 360, a height of each continuous channels 340A, 340B as measured in a longitudinal direction from a peak to a trough of the continuous channel may be reduced relative to continuous channels 140 of beverage container 100. As discussed with respect to diagonal regions 142, the angle of diagonal regions 342 of continuous channels 340A, 340B extending between a peak and a trough of continuous channel 340A, 340B may form an angle of 40 to 50 degrees relative to a plane transverse to a longitudinal axis of the beverage container 300, and in some embodiments the angle may be 45 degrees. Further, a lower bound $L_1$ of upper continuous channel 340A may be arranged above an upper bound $U_2$ of lower continuous channel 340B in the longitudinal direction of the beverage container 300. Lower bound $L_1$ of upper continuous channel 340A may be spaced from upper bound $U_2$ of lower continuous channel 340B, and central channel 350 may be arranged in a plane $X_5$ between lower bound $L_1$ of upper continuous channel 340A and upper bound $U_2$ of lower continuous channel 340B.

In some embodiments, beverage container 300 may further include linear channel segments 370. Linear channel segments 370 may have the same shape, arrangement, and functions as described above with respect to linear channel segments 170. Linear channel segments 370 may be arranged above upper continuous channel 340A and may be arranged below lower continuous channel 340B. In some embodiments, as shown in FIG. 6, no linear channel segments 370 are arranged between upper continuous channel 340A and central channel 350 and between lower continuous channel 340B and central channel 350.

Figure 7:
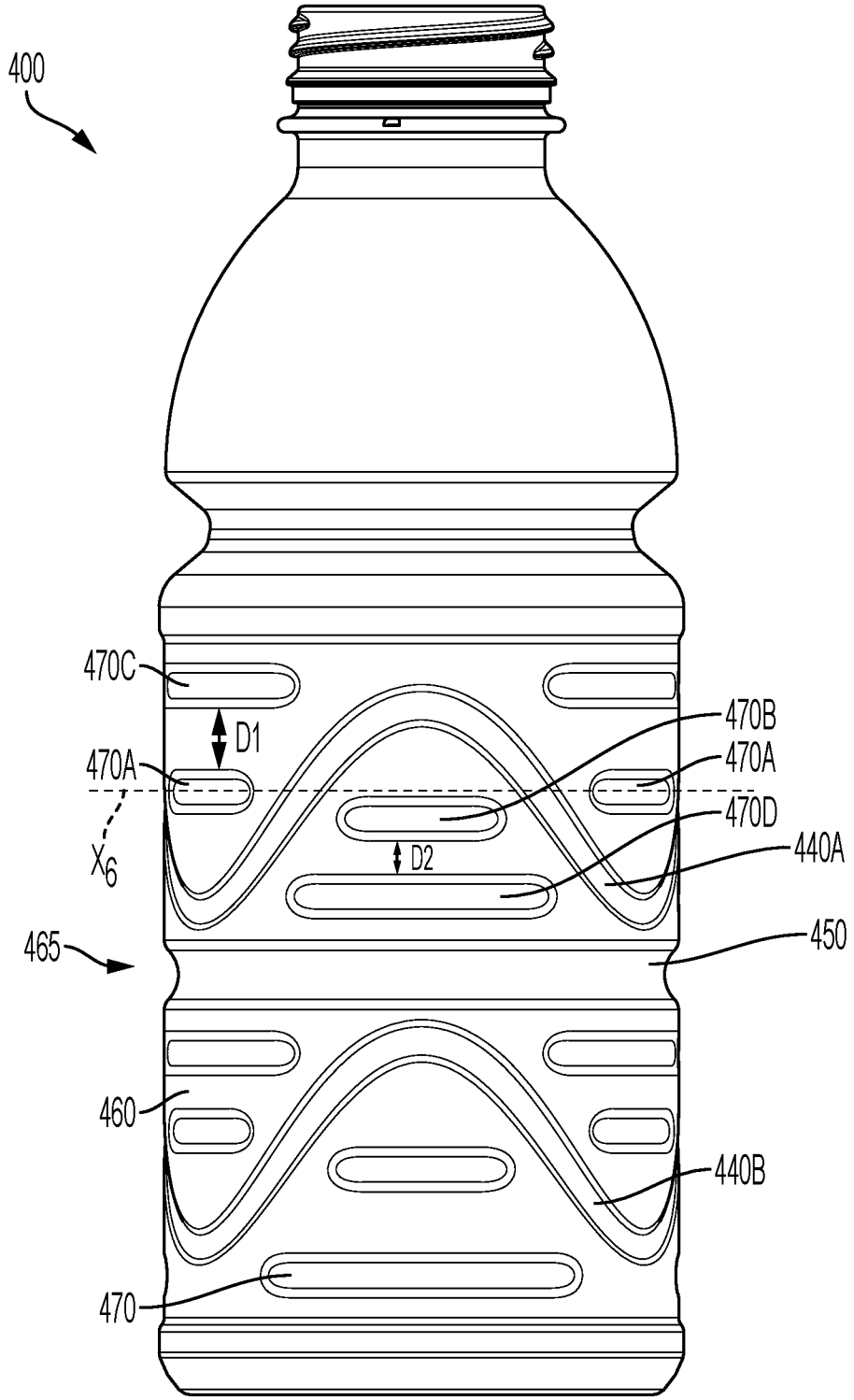
FIG. 7 shows a side view of a beverage container according to an embodiment.

In some embodiments, however, linear channel segments 470 may additionally be arranged between upper continuous channel 440A and central channel 450 and also between lower continuous channel 440B and central channel 450, as shown for example in FIG. 7. Beverage container 400 may be the same as beverage container 300 but additionally includes linear channel segments 470 arranged between upper continuous channel 440A and central channel 450 and between lower continuous channel 440B and central channel 450. However, in some embodiments, beverage container may include linear channel segments 470 between upper continuous channel 440 and central channel 450 with no linear channel segments 470 between lower continuous channel 440B and central channel 450, or vice versa. The additional linear channel segments 470 may help to further resist or prevent paneling of sidewall 460.

Linear channel segments 470 may be arranged in one or more planes transverse to a longitudinal axis of beverage container 400. In some embodiments, linear channel segments 470 that are arranged above and below each continuous channel 440 may not be in the same plane and may instead be staggered. For example, as shown in FIG. 7, linear channel segments 470A are arranged above upper continuous channel 440A and are arranged in a common plane $X_6$. However, linear channel segments 470B arranged below upper continuous channel 440A are not arranged in the same plane $X_6$ as linear channel segments 470A and are instead staggered relative to linear channel segments 470A. By staggering linear channel segments 470, different zones of strength may be created on sidewall 460.

Further, linear channel segments 470 arranged above a continuous channel 440 may be spaced from one another at a different distance in a longitudinal direction than linear channel segments arranged below continuous channel 440. For example, as shown in FIG. 7, linear channel segments 470A, 470C arranged above continuous channel 440A may be spaced from one another at a first distance $D_1$ in a longitudinal direction of beverage container 400, whereas linear channel segments 470B, 470D arranged below upper continuous channel 440A may be spaced from one another at a second distance $D_2$ in the longitudinal direction of beverage container 400. The first distance $D_1$ may be different from the second distance Dz. Channel segments 470B, 470D are spaced more closely together in embodiments where a portion of sidewall 460 between upper continuous channel 440A and central channel 450 may be smaller than a portion of sidewall 460 above upper continuous channel 440A. Accordingly, the spacing of the linear channel segments 470 may be smaller to accommodate the smaller space.

In some embodiments, a beverage container 100, 200, 300, 400 as described herein may be configured to resist elongation during a hot-filling operation such that the elongation of the beverage container is 1.5% or less, 1.25% or less, or 1.0% or less of the original height of the bottle.

In order to determine resistance of a beverage container to paneling, the beverage container can be filled with a liquid and sealed, and then some amount of the liquid can be extracted from the beverage container under a vacuum (e.g., via a syringe that pierces the bottle). In order to resist paneling of the beverage container due to pressure changes normally experienced during filling and storage of a beverage container, such as due to contraction resulting from cooling of the hot-filled liquid and evaporative losses of the beverage over time, the sidewall of the beverage container may be intended to withstand removal of a volume of liquid that is 0% to 7%, 1.5% to 6.5%, or 3% to 6% of the total volume of the beverage container which will correspond to the % volume reduction due to thermal contraction of the beverage in a production scenario.

Figure 8:
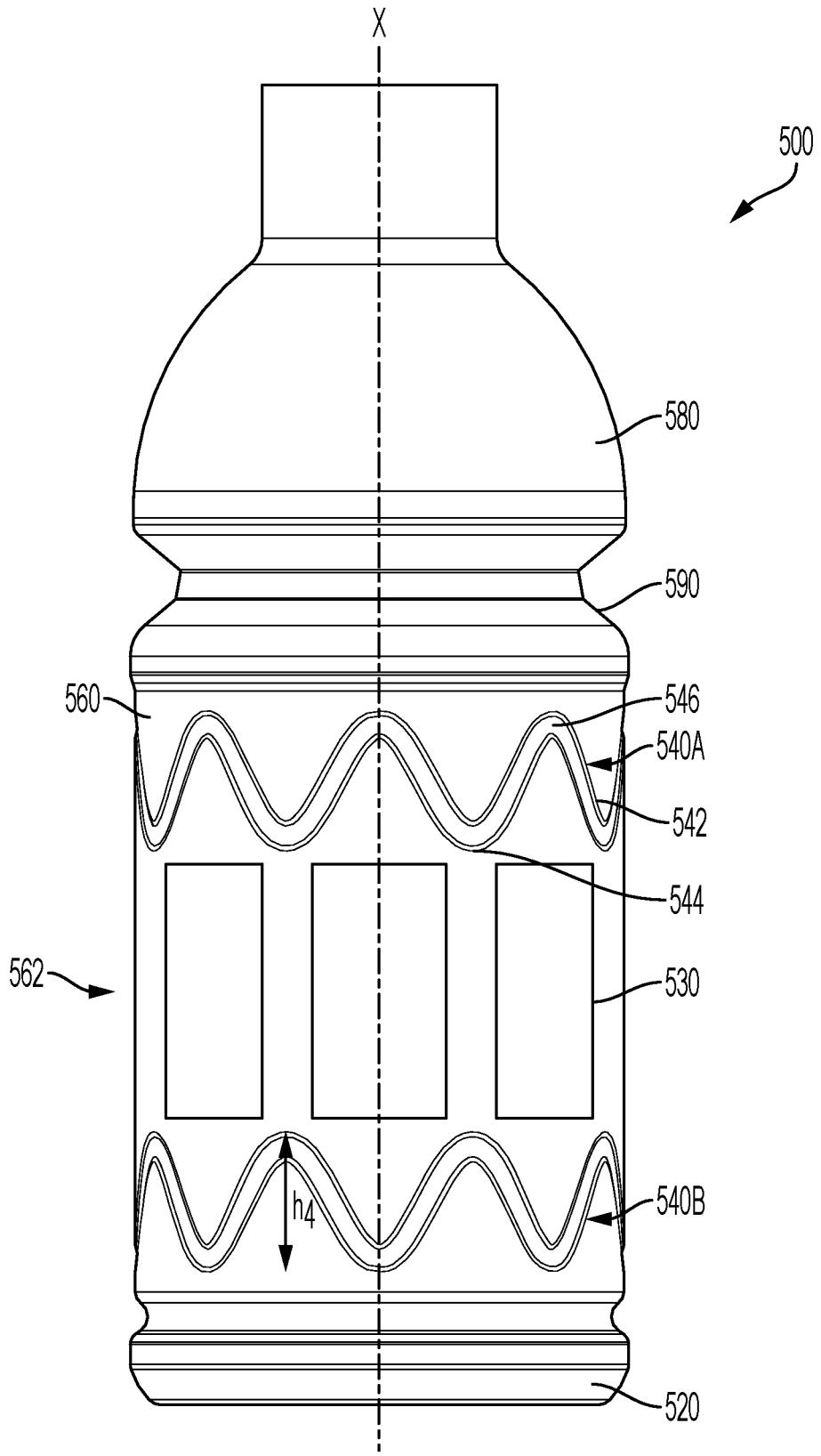
FIG. 8 shows a side view of a beverage container having vacuum panels according to an embodiment.

Some embodiments described herein are directed to a beverage container 500 that includes a sidewall 560 having a continuous channel 540 and one or more vacuum panels 530, as shown for example in FIG. 8. Beverage container 500 may be formed as discussed above with respect to beverage containers 100, 200, 300, 400 and thus may have a base 520, a sidewall 560 extending from an integrally formed with base 520, and an upper region 580 extending from and integrally formed with sidewall 560 and defining an upper opening. Beverage container 500 may include a recessed region 590 where sidewall 560 transitions to upper region 580, and sidewall 560 may be cylindrical such that beverage container 500 has a generally circular transverse cross section.

In some embodiments, as shown in FIG. 8, sidewall 560 may include one or more continuous channels 540 formed in sidewall 560 and extending around a circumference of sidewall 560. In some embodiments, continuous channel 540 may have a series of alternating peaks 546 and troughs 544 separated by diagonal portions 542, such that continuous channel 540 has a sinusoidal shape. Diagonal portions 542 may be generally linear or may have a slight curvature so as to be curvilinear.

In some embodiments, as shown in FIG. 8, beverage container 500 may include a sidewall 560 having an upper continuous channel 540A and a lower continuous channel 540B. In some embodiments, upper and lower continuous channels 540A, 540B may have the same configuration and dimensions. Upper continuous channel 540A and lower continuous channel 540B may be separated by a space 562. Space 562 may be measured from a transverse plane at a lower bound of upper continuous channel 540A to an upper bound of the lower continuous channel 540B in a direction parallel to a longitudinal axis of beverage container 500.

When applying a label to beverage container 500, label may be affixed to portions of sidewall 560 adjacent continuous channels 540A, 540B. Continuous channels 540A, 540B help to maintain a cylindrical sidewall 560 which facilitates application of the label to sidewall 560. To help provide area to support a label on beverage container 500, each continuous channel 540A, 540B may have a height $h_4$ of 15 mm to 25 mm, 16 mm to 24 mm or 18 mm to 22 mm, wherein the height $h_4$ is measured from a trough 544 to a peak 546 of the continuous channel 540 in a longitudinal direction of beverage container 500. In some embodiments, the height $h_4$ may be in a range of about 15 mm to about 25 mm. This may help to facilitate application of a label to sidewall 560 by providing a sufficient area for attaching the label to sidewall 560. In some embodiments, the total combined height $h_4$ of continuous channels 540A, 540B may be in a range of 30% to 80% of a total height of sidewall 560 of beverage container 500.

In some embodiments, diagonal portions 542 of continuous channels 540 may be oriented at an angle relative to a plane that is transverse to a longitudinal axis of the beverage container of 40 to 50 degrees. In some embodiments, the angle may be 45 degrees so as to balance resistance to paneling when beverage container 500 is subjected to a pressure differential and resistance to elongation during hot-filling operations. As the angle decreases, such that continuous channel 540 is flattened and the sinusoidal pattern has a lower height $h_4$, the resistance to elongation provided by continuous channel 540 decreases while the resistance to paneling increases.

In some embodiments, each continuous channel 540 of beverage container 500 having vacuum panels 530 may have seven to ten peaks. The number of peaks may be selected in order for the continuous channel 540 to extend continuously around the circumference of sidewall 560 while maintaining continuous channel 540 in the desired height $h_4$ and with an angle of the diagonal portions 542 of continuous channel 540 in the desired range. Generally, as the number of peaks decreases, with the angle of the diagonal portion of the continuous channel and the dimensions of the sidewall 560 remaining constant, the height of the continuous channel increases.

Sidewall 560 of beverage container 500 further includes one or more vacuum panels 530 to help absorb the change in pressure exerted on beverage container 500 during cooling of a beverage after hot-filling the beverage into beverage container 500. Vacuum panels 530 may deform in order to prevent paneling of a remainder of sidewall 560. In embodiments having vacuum panels 530 on sidewall 560, base 520 of beverage container 500 may not need to be designed to accommodate change in pressure. However, in some embodiments, base 520 may include features that can flex or deform in order to help to absorb the change in pressure.

In some embodiments, one or more vacuum panels 530 are formed in sidewall 560 and are arranged between upper and lower continuous channels 540A, 540B. Vacuum panels 530 may have a recessed configuration and may extend inwardly toward an interior of beverage container 500. In some embodiments, vacuum panels 530 may have a perimeter in the shape of a square, rectangle, circle, or oval, among other shapes. Vacuum panels 530 may be arranged around a circumference of sidewall 560. Vacuum panels 530 may be evenly spaced around the circumference to evenly distribute the forces exerted on beverage container 500.

In some embodiments, vacuum panels 530 may be arranged between an upper continuous channel 540A and a lower continuous channel 540B. In some embodiments, upper continuous channel 540A may be arranged in-phase with respect to lower continuous channel 540B such that a peak 546 of an upper continuous channel 540A is aligned with a peak 546 of lower continuous channel 540B along an axis parallel to a longitudinal axis X of beverage container 500. However, in some embodiments, upper continuous channel 540A may be arranged out-of-phase with respect to lower continuous channel 540B such that a peak 546 of an upper continuous channel 540A is aligned with a trough 544 of lower continuous channel 540B along an axis parallel to a longitudinal axis X of beverage container 500. When upper and lower continuous channels 540A, 540B are arranged out of phase, more space is provided on sidewall 560 between channels 540A, 540B in which vacuum panel 530 may be arranged. Each vacuum panel 530 may be centered along an axis extending between a peak 546 of upper continuous channel 540A and a trough 544 of lower continuous channel 540B. In embodiments in which vacuum panels 530 are arranged in between a peak 546 of upper continuous channel 540A and a trough 544 of lower continuous channel 540B, vacuum panels 530 may extend above a lower bound of upper continuous channel 540A and may extend below an upper bound of lower continuous channel 540B. Further, each vacuum panel 530 may have a width that is less than a circumferential distance from a first peak 546 to an adjacent second peak 546 of lower continuous channel 540B. In this way, each vacuum panel 530 may be arranged in a space between adjacent peaks 546 without contacting or overlapping with an adjacent vacuum panel 530. In some embodiments, a number of vacuum panels 530 may correspond to a number of peaks 546 of a continuous channel 540A, 540B.

Figure 9:
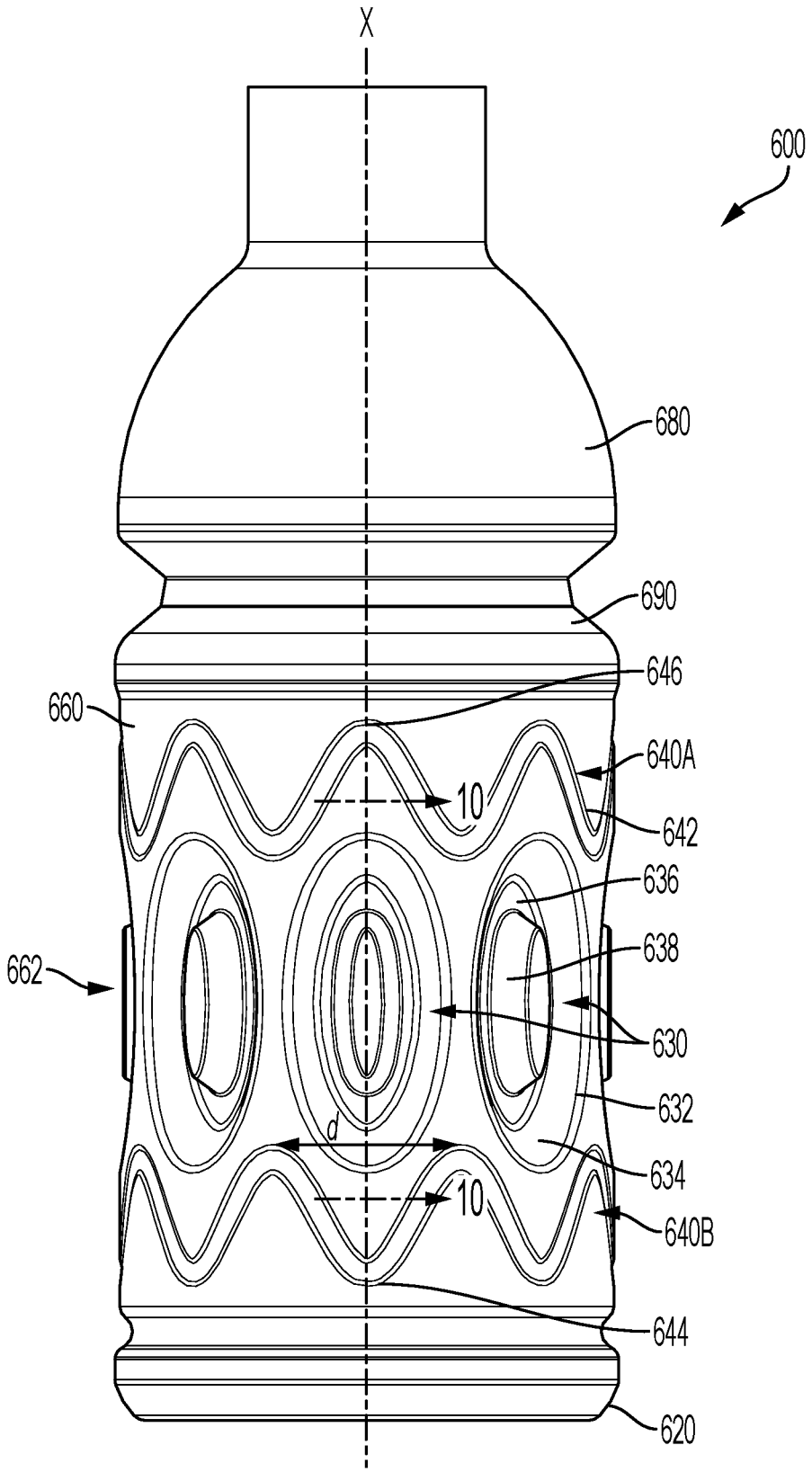
FIG. 9 shows a side view of a beverage container having vacuum panels according to an embodiment.

In some embodiments, vacuum panels 630 may have a configuration as shown, for example, in FIG. 9. Sidewall 660 of a beverage container 600 may include one or more vacuum panels 630 formed in sidewall 660. In embodiments having multiple vacuum panels 630, vacuum panels 630 may be formed in sidewall 660 and arranged around a circumference of sidewall 660. In some embodiments, vacuum panels 630 may be spaced evenly around circumference.

Figure 14:
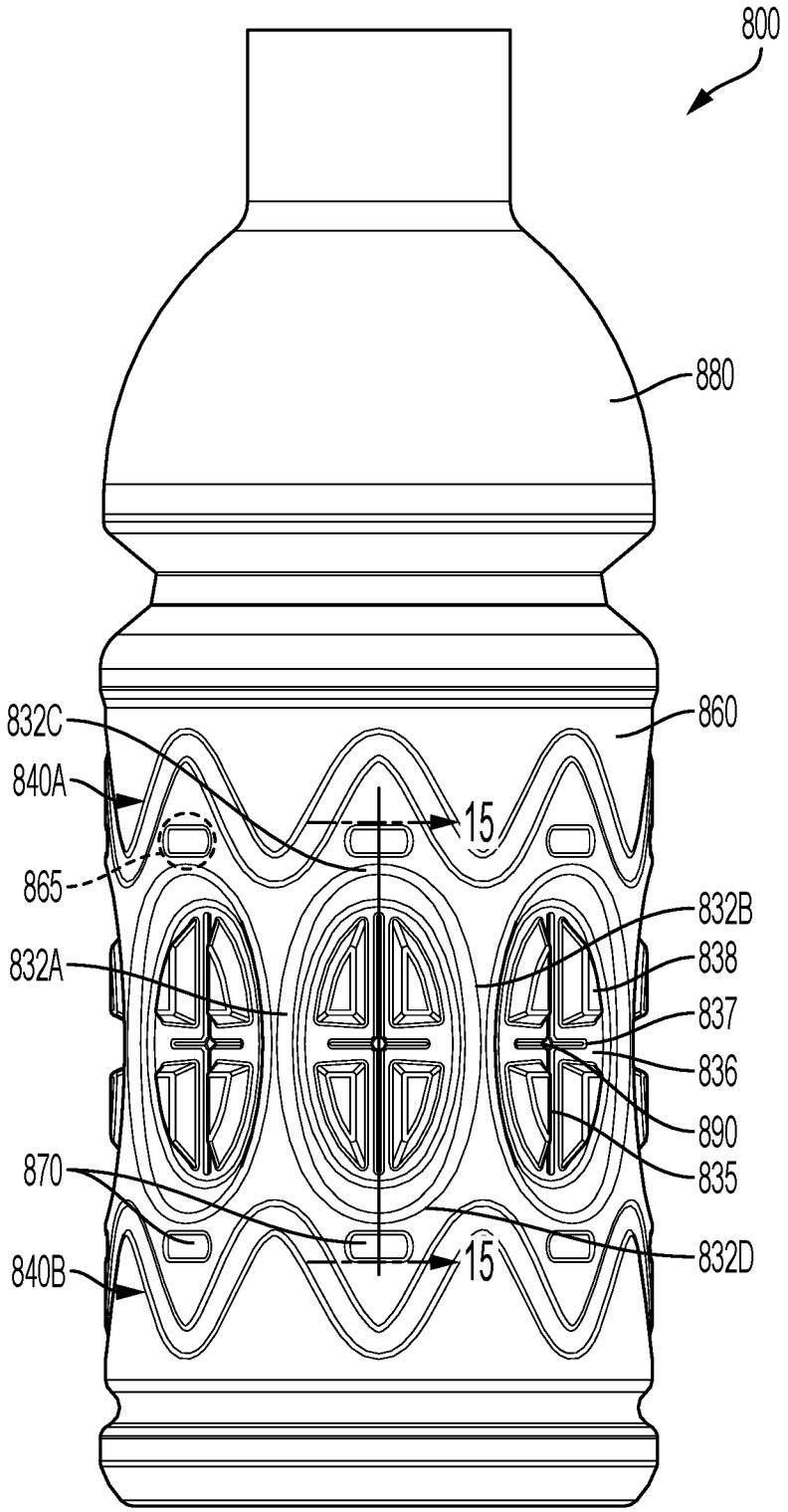
FIG. 14 shows a side view of a beverage container having a vacuum panel according to an embodiment.

Vacuum panels 630 may have an oval or elliptical shape. In some embodiments, vacuum panel 630 may have an oval shape with shortened and rounded ends, as discussed with respect to vacuum panel 830 as shown in FIG. 14. Vacuum panels 630 having an oval shape may include a long dimension extending parallel to a longitudinal axis X of beverage container 600 and a short dimension extending circumferentially of beverage container 600. The long dimension may be greater than the short dimension, such that each vacuum panels 630 has a greater height than width. In embodiments having multiple vacuum panels 630, vacuum panels 630 may each have the same shape and configuration.

In some embodiments, vacuum panels 630 may be arranged between an upper continuous channel 640A and a lower continuous channel 640B. Upper continuous channel 640A may be arranged with respect to lower continuous channel 640B such that a peak 646 of an upper continuous channel 640A is aligned with a trough 644 of lower continuous channel 640B along an axis parallel to a longitudinal axis X of beverage container 600. In this way, more space is provided on sidewall 660 in which vacuum panel 630 may be arranged. In some embodiments, the long dimension of vacuum panel 630 may be arranged along the longitudinal axis X. As vacuum panels 630 are arranged in between a peak 646 of upper continuous channel 640A and a trough 644 of lower continuous channel 640B, vacuum panels 630 may extend above a lower bound of upper continuous channel 640A and may extend below an upper bound of lower continuous channel 640B. Further, each vacuum panel 630 may have a width that is less than a circumferential distance d from a first peak 646 to an adjacent second peak 646 of the lower continuous channel 640B, as shown in FIG. 9. In this way, each vacuum panel 630 may be arranged in a space between adjacent peaks 646 without contacting or overlapping with an adjacent vacuum panel 630. In some embodiments, a number of vacuum panels 630 may correspond to a number of peaks 646 of upper continuous channel 640A (or lower continuous channel 640B). Each vacuum panel 630 may be centered along an axis extending between a peak 646 of upper continuous channel 640A and a trough 644 of lower continuous channel 640B.

Figure 10:
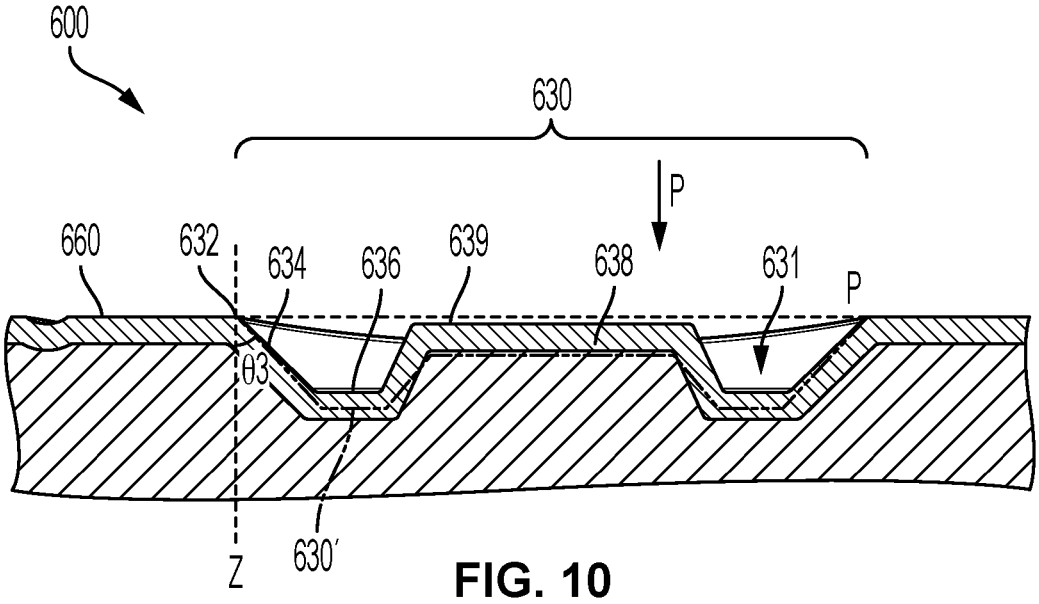
FIG. 10 shows a cross-sectional view of a vacuum panel of the beverage container of FIG. 9 as taken along line 10-10 in FIG. 9.

As shown in FIG. 10, each vacuum panel 630 may include a recessed configuration and may include one or more projections 638 extending from a bottom 636 of vacuum panel 630. Projection 638 may have an upper end 639 that is generally flat. In this way, when a label is affixed to beverage container 600, label may be supported by sidewall 660 and by projections 638 of vacuum panels 630. In some embodiments, upper end 639 of projection 638 may be arranged at an elevation that is lower than a plane P of sidewall 660 of beverage container 600. In this way, sidewall 660 may contact guide surfaces during conveying of beverage container 600 and limit or prevent contact of guide surfaces with projections 638. Projection 638 may be arranged centrally on vacuum panel 630, such that vacuum panel 630 forms a gutter 631 surrounding projection 638 and between perimeter 632 and projection 638. Projection 638 may have a shape corresponding to a shape of perimeter 632 of vacuum panel 630. For example, if perimeter 632 has an oval shape, then projection 638 may similarly have an oval shape (see, e.g., FIG. 9).

Each vacuum panel 630 may include an inner wall 634 that slopes from sidewall 660 of beverage container 600 at perimeter 632 of vacuum panel 630 to bottom 636 of vacuum panel 630. Bottom 636 of vacuum panel 630 is recessed from a plane of sidewall 660 of beverage container 600, and thus vacuum panel 630 extends inwardly from sidewall 660 toward interior volume of beverage container 600. In some embodiments, inner wall 634 may be generally linear, and inner wall 634 may be sloped at an angle $\theta_3$ of about 1 degree to about 50 degrees relative to a longitudinal axis Z of vacuum panel 630, as shown in FIG. 10. In some embodiments, inner wall 634 may have a shallow slope, e.g., 50°. In some embodiments, inner wall 634 may be steeply sloped, e.g., 1°. As the angle decreases, i.e., as the angle becomes steeper, the amount of flexion provided by the vacuum panel 630 increases.

When beverage container 600 is subjected to a change in pressure, such as a change in pressure along direction P, vacuum panel 630 may deform to help absorb the change in pressure such that the remainder of sidewall 660 retains its configuration. A shape of vacuum panel 630 in a deformed state is shown for example in dotted lines 630'. In the deformed state, vacuum panel 630 may flex inwardly such that an angle of inner wall 634 decreases and projection 638 may flatten.

Figure 11:
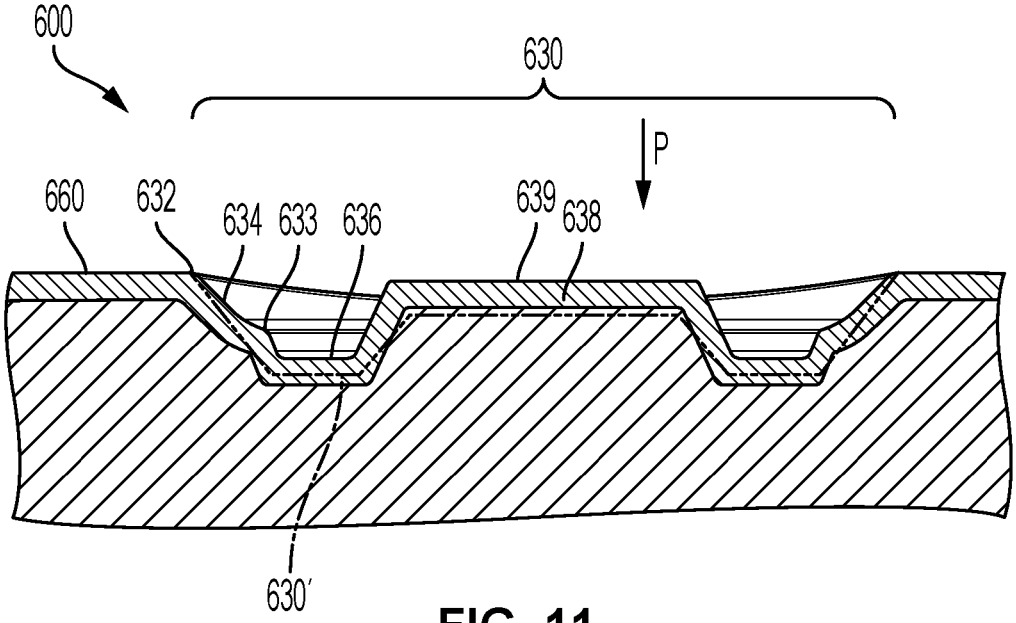
FIG. 11 shows a cross-sectional view of a vacuum panel of a beverage container according to an embodiment.

In some embodiments, as shown in FIG. 11, inner wall 634 may be non-linear and may further include a step 633. Step 633 may include a region that extends outwardly from inner wall 634 such that inner wall is non-linear. Step 633 may have a different slope than a remainder of inner wall 634. Step 633 may allow for additional deformation of vacuum panel 630 when beverage container is subjected to a change in pressure upon cooling of the hot-filled beverage in the beverage container. Inner wall 634 may slope from perimeter 632 at sidewall 660 to step 633, and step 633 may in turn slope to bottom 636. Step 633 is configured to provide increased flexion of vacuum panel 630 when beverage container 600 is subjected to a change in pressure. In some embodiments, step 633 may be arranged at a distance of 25% to 50% of the distance from plane P to bottom 636 of vacuum panel 630 in the longitudinal direction Z. When beverage container 600 is subjected to a change in pressure, step 633 may flatten. As discussed above, inner wall 634 may be arranged at an angle of about 1° to about 50° relative to a longitudinal axis of vacuum panel 630.

When beverage container 600 is subjected to a change in pressure, such as a change in pressure along direction P, vacuum panel 630 may deform to help absorb the change in pressure such that a remainder of the sidewall 660 retains its configuration. A shape of vacuum panel 630 in a deformed state is shown for example by dotted line 630'. In the deformed state, vacuum panel 630 may flex inwardly such that angle of inner wall 634 decreases and step 633 flattens. Further, projection 638 may also flatten.

Figure 12:
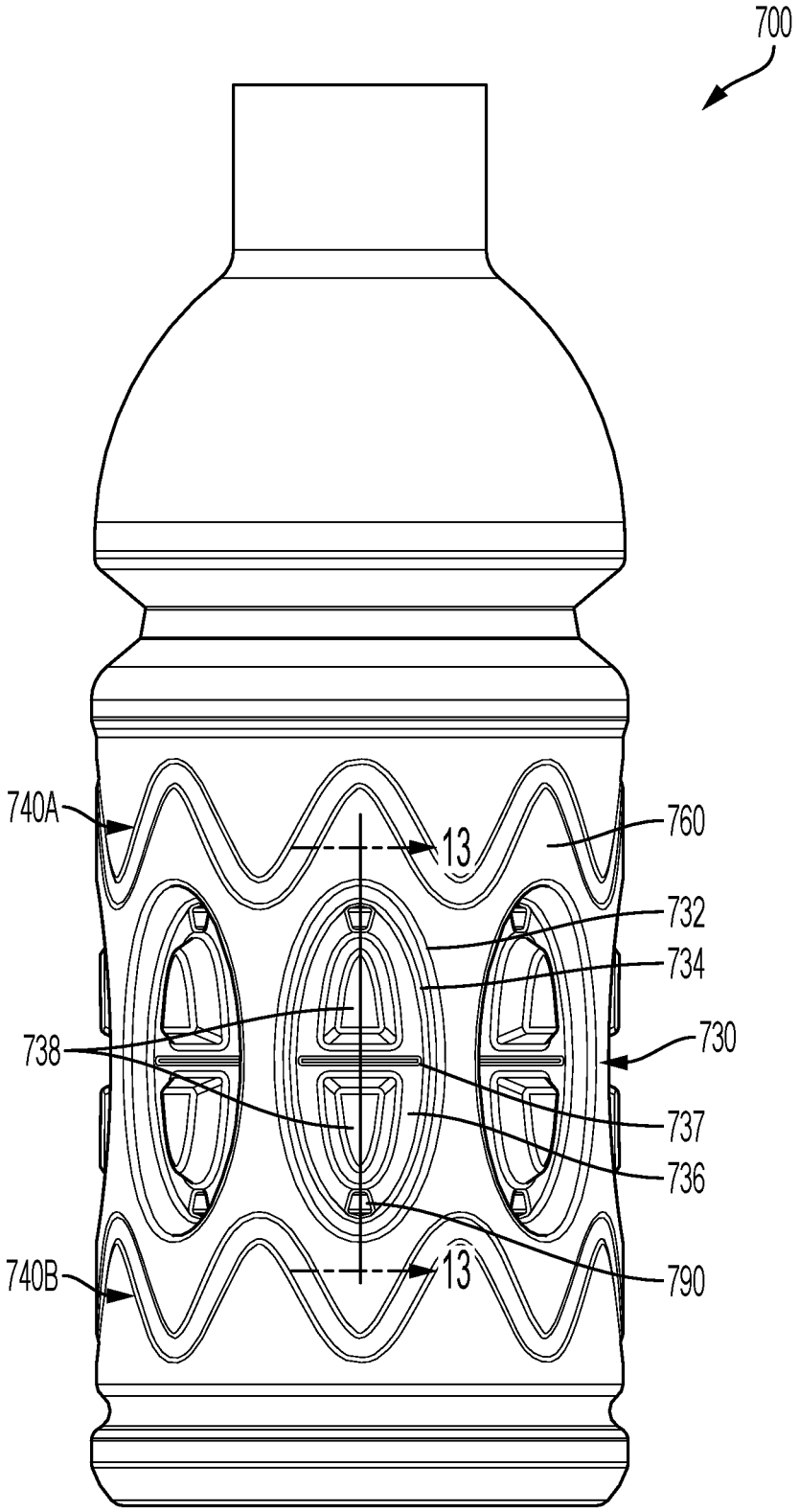
FIG. 12 shows a side view of a beverage container having a vacuum panel according to an embodiment.

In some embodiments, a beverage container 700 may include a vacuum panel 730 as shown in FIG. 12. Vacuum panel 730 may have the same construction and features as described with respect to vacuum panel 630 except where noted. Vacuum panel 730 includes a trench 737 that extends along bottom 736 of vacuum panel 730. In some embodiments, trench 737 may extend along the short dimension of vacuum panel 730, i.e., along a circumferential direction of sidewall 760. Trench 737 may serve as a hinge to allow vacuum panel 730 to deform in two directions. Trench 737 may be arranged centrally on vacuum panel 730 so as to bisect vacuum panel 730 into upper and lower halves. Thus, vacuum panel 730 may include a first projection 738 on a first side of trench 737, and a second projection 738 on an opposing second side of trench 737. In this way, trench 737 essentially bisects projection 638 of vacuum panel 630 of beverage container 600 shown in FIG. 9.

In some embodiments, trench 737 may extend along bottom 736 of vacuum panel 730 along the long dimension of vacuum panel 730, i.e., along a longitudinal direction of sidewall 760. Trench 737 may be arranged centrally on vacuum panel 730 so as to bisect vacuum panel 730 into left and right halves. In such embodiments, vacuum panel 730 may include a first projection 738 on a first side of trench 737 and a second projection 738 on an opposing second side of trench 737. Further, in some embodiments, vacuum panel 730 may include a trench 737 extending along both the short dimension and the long dimension (see, e.g., FIG. 14), such that the vacuum panel is divided into quarters.

Figure 13:
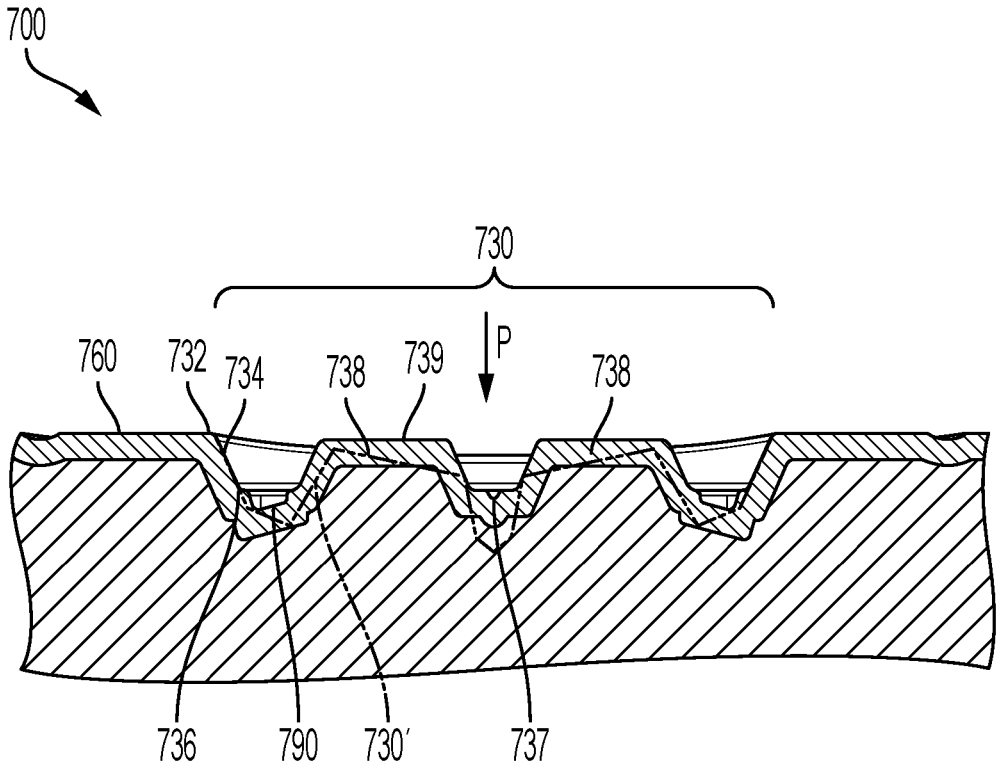
FIG. 13 shows a cross-sectional view of a vacuum panel of the beverage container of FIG. 12 as taken along line 13-13 in FIG. 12.

In some embodiments, vacuum panel 730 may further include one or more recesses 790, as shown in FIGS. 12 and 13. Recesses 790 may be arranged on bottom 736 of vacuum panel 730. Recess 790 may be a depression or cavity in bottom 736 that extends inwardly toward interior volume of beverage container 700. Recesses 790 are configured to allow for further deformation of vacuum panel 730. In some embodiments, a first recess 790 may be arranged at upper end of vacuum panel 730 and a second recess 790 may be arranged at an opposing lower end of vacuum panel 730 in a direction of a longitudinal axis of beverage container 700. In some embodiments, additional or fewer recesses 790 may be present.

Similar to vacuum panel 630, vacuum panel 730 may include an inner wall 734 that slopes from perimeter 732 at sidewall 760 to bottom 736 of vacuum panel 730, as best shown in FIG. 13. Inner wall 734 may have the same arrangement and features as described with respect to inner wall 634 of vacuum panel 630, and thus may be arranged at an angle of about 1° to about 50° relative to a longitudinal axis of vacuum panel, and in some embodiments may further include a step (see, e.g., step 633 in FIG. 11). Projections 738 may extend from bottom 736 and may have an upper end 739 that is generally flat. Upper end 739 may be arranged at an elevation below a plane of sidewall 760 of beverage container 700. Vacuum panel 730 may include a recess 790 in bottom 736 that extends inwardly toward interior volume of beverage container 700.

When beverage container 700 is subjected to a change in pressure, such as a change in pressure along direction P, vacuum panel 730 may deform to help absorb the change in pressure such that a remainder of the sidewall 760 retains its configuration and dimensions. A shape of vacuum panel 730 in a deformed state is shown for example by dotted line 730'. In the deformed state, vacuum panel 730 may flex inwardly and projections 738 may move toward one another pivoting about trench 737. As projections 738 move toward one another, recesses 790 may flatten to facilitate movement of projections 738.

In some embodiments, beverage container 800 may include vacuum panels 830, as shown in FIG. 14. Vacuum panel 830 may include a recessed configuration and may include an inner wall 834 that slopes from a perimeter 832 at sidewall 860 to a bottom 836, and may include projections 838 extending from bottom 836. Vacuum panels 830 may have the same arrangement, construction and features as described above with respect to vacuum panels 630, 730 except as noted.

Similar to vacuum panel 730, vacuum panel 830 may include a trench 837 extending along a short dimension of vacuum panel 830, i.e., along a circumferential direction. Trench 837 may bisect vacuum panel 730 into upper and lower halves. Vacuum panel 830 may further include a second trench 835 extending along a long dimension of vacuum panel 830, i.e., in a longitudinal direction of sidewall 860. Trenches 835, 837 may divide vacuum panel 830 into quarters, and a projection 838 may be arranged in each quarter. Trenches 835, 837 may be perpendicular to one another. Trenches 835, 837 may allow for flexing of vacuum panel 830 in multiple directions. In some embodiments, vacuum panel 830 may further include one or more recesses 890 to facilitate deformation of vacuum panel 830. In some embodiments, a recess 890 may be formed at an intersection of trenches 835, 837 as shown in FIG. 14.

Vacuum panel 830 may have a perimeter 832 that is shaped generally as an oval with shortened and rounded ends. As shown in FIG. 14, vacuum panel 830 may include a perimeter 832 with a first side 832A opposite a second side 832B, and with an upper end 832C opposite a lower end 832D. First and second sides 832A, 832B of vacuum panel 830 may correspond to an oval shape. However, upper and lower ends 832C, 832D may correspond to a circular shape. In this way, upper and lower ends 832C, 832D of vacuum panel 830 are shortened and are more rounded relative to a vacuum panel having an oval shape. In operation, as an vacuum panel having an oval shape deforms, vacuum panel may direct forces toward portions 865 (circled in dotted lines for illustration) of the sidewall 860 adjacent the upper and lower ends 832C, 832D of vacuum panel 830 which may make these portions 865 more susceptible to paneling. Upper and lower ends 832C, 832D following a circular shape rather than an oval shape may help to better distribute the forces to sidewall 860 and avoid directing the forces toward portions 865 of sidewall 860 adjacent upper and lower ends 832C, 832D of vacuum panel 830. However, in some embodiments, vacuum panel 830 may have an oval shape.

In some embodiments, beverage container 800 may include vacuum panels 830 and may further include one or more linear channel segments 870 as described herein. Linear channel segments 870 may be arranged along a portion of a circumference of sidewall 860 of beverage container 800. In some embodiments, multiple linear channel segments 870 may be arranged along a circumference of sidewall 860 in the same plane. In some embodiments, linear channel segments 870 may be arranged below upper continuous channel 840A and above lower continuous channel 840B. Linear channel segments 870 may be arranged at portions 865 of sidewall 860 adjacent upper and lower ends 832C, 832D of vacuum panel 830 in order to reinforce the sidewall 860 and help to prevent paneling. However, in some embodiments, linear channel segments 870 may alternately or additionally be arranged above upper continuous channel 840A and below lower continuous channel 840B.

Figure 15:
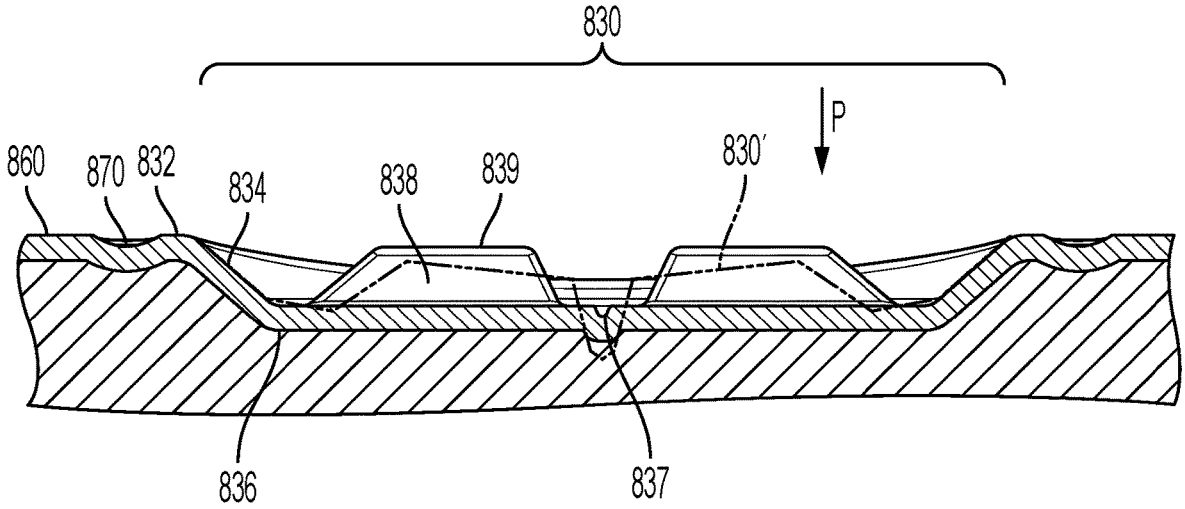
FIG. 15 shows a cross-sectional view of a vacuum panel of the beverage container of FIG. 14 as taken along line 15-15 in FIG. 14.

As shown in FIG. 15, vacuum panel 830 includes an inner wall 834 that slopes from a perimeter 832 at sidewall 860 to a bottom 836. Projections 838 may extend from bottom 836 and may have an upper end 839 that is generally flat. Upper end 839 may be arranged at an elevation below a plane of sidewall 860 of beverage container 800. A trench 837 is formed in bottom 836 and between projections 838. A linear channel segment 870 may be formed in sidewall 860 adjacent vacuum panel 830.

When beverage container 800 is subjected to a change in pressure, such as a change in pressure along direction P, vacuum panel 830 may deform to help absorb the change in pressure such that a remainder of the sidewall 860 retains its configuration and dimensions. A shape of vacuum panel 830 in a deformed state is shown for example in dotted lines 830'. In the deformed state, vacuum panel 830 may flex inwardly and projections 838 may move toward one another pivoting about trenches 835, 837. As projections 838 move toward one another, recess 890 may deform to facilitate movement of projections 838. Sidewall 860 may include linear channel segments 870 adjacent vacuum panel 830 that help to provide sidewall 860 with hoop strength to further prevent paneling of sidewall 860 as vacuum panel 830 deforms.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the claims and their equivalents.

What is claimed is:

1. A beverage container, comprising:

a base;

a sidewall extending from and integrally formed with the base;

an upper region extending from the sidewall and defining an upper opening, wherein the beverage container comprises a longitudinal axis extending in a direction from the base to the upper opening;

a first continuous channel formed in and extending continuously around a circumference of the sidewall, wherein the first continuous channel comprises peaks and troughs connected by diagonal regions, and wherein the first continuous channel is configured to resist paneling and elongation of the beverage container;

a second continuous channel formed in and extending continuously around a circumference of the sidewall, wherein the second continuous channel comprises peaks and troughs connected by diagonal regions, and wherein the second continuous channel is configured to resist paneling and elongation of the beverage container; and a central channel formed in and extending continuously around a circumference of the sidewall at a central portion of the sidewall between the first and second continuous channels, wherein the central channel is configured to resist paneling of the beverage container.

2. The beverage container of claim 1, wherein the central channel is arranged in a plane transverse to the longitudinal axis of the beverage container.

3. The beverage container of claim 1, wherein the central channel is arranged at a midpoint of the sidewall in the direction of the longitudinal axis.

4. The beverage container of claim 1, wherein the diagonal regions of the first continuous channel form an angle of 40 to 50 degrees relative to a plane transverse to the longitudinal axis of the beverage container.

5. The beverage container of claim 1, further comprising linear channel segments formed in the sidewall and extending along a circumference of the sidewall, wherein the linear channel segments are configured to resist paneling of the sidewall when an internal pressure of the beverage container is less than an external pressure.

6. The beverage container of claim 5, wherein one or more of the linear channel segments are arranged on the sidewall between the first continuous channel and the central channel.

7. The beverage container of claim 6, wherein one or more of the linear channel segments are arranged on the sidewall above the first continuous channel.

8. The beverage container of claim 1, wherein the peaks of the first continuous channel and the peaks of the second continuous channel are aligned in the direction of the longitudinal axis of the beverage container.

9. The beverage container of claim 1, wherein the central channel has a width in a range of 3 mm to 12 mm, wherein the width is measured in a direction transverse to the central channel from a first side of the central channel to a second side of the central channel opposite the first side.

10. The beverage container of claim 1, wherein the central channel has a depth of 0.5 mm to 8 mm as measured from a plane of the sidewall to a deepest portion of the central channel.

11. The beverage container of claim 1, wherein the central channel has a width and a depth, wherein the width is greater than the depth.

12. The beverage container of claim 1, further comprising a second central channel formed in and extending continuously around the circumference of the sidewall at the central portion of the sidewall between the first and second continuous channels.

13. The beverage container of claim 1, further comprising a first plurality of linear channel segments formed in the sidewall and extending along a circumference of the sidewall in a first plane, and a second plurality of linear channel segments formed in the sidewall and extending along the circumference of the sidewall in a second plane that is different than the first plane.

14. The beverage container of claim 13, wherein each of the first plurality of linear channel segments has a first length in a circumferential direction, and each of the second plurality of linear channel segments has a second length in the circumferential direction, wherein the first length differs from the second length.

15. The beverage container of claim 13, wherein the first and second pluralities of linear channel segments are arranged above the first continuous channel.

16. The beverage container of claim 15, further comprising a third plurality of linear channel segments formed in the sidewall and extending along the circumference of the sidewall in a third plane, and a fourth plurality of linear channel segments formed in the sidewall and extending along the circumference of the sidewall in a fourth plane that is different than the third plane.

17. The beverage container of claim 16, wherein the third and fourth pluralities of linear channel segments are arranged below the first continuous channel.

18. The beverage container of claim 17, wherein the third and fourth pluralities of linear channel segments are arranged above the central channel.

19. The beverage container of claim 17, wherein a distance between the first plurality of linear channel segments and the second plurality of linear channel segments in a longitudinal direction is different than a distance between the third plurality of linear channel segments and the fourth plurality of linear channel segments in the longitudinal direction.

20. The beverage container of claim 16, wherein the first plane, the second plane, the third plane, and the fourth plane are each different planes.

* * * * *